US006010084A

United States Patent [19]

Yoshida et al.

[11] Patent Number: 6,010,084

[45] Date of Patent: Jan. 4, 2000

[54] PAINT SPRAYING DEVICE

[75] Inventors: Osamu Yoshida; Hidetsugu Matsuda, both of Tokyo, Japan

[73] Assignee: ABB Industry K.K., Tokyo, Japan

[21] Appl. No.: 09/043,120

[22] PCT Filed: Jul. 15, 1997

[86] PCT No.: PCT/JP97/02446

§ 371 Date: Mar. 18, 1998

§ 102(e) Date: Mar. 18, 1998

[87] PCT Pub. No.: WO98/03268

PCT Pub. Date: Jan. 29, 1998

[30] Foreign Application Priority Data

Jul. 18, 1996 [JP] Japan ..... 8-207949

[51] Int. Cl.[7] ..... B05B 5/00

[52] U.S. Cl. ..... 239/703; 239/112; 239/223; 239/290; 239/600

[58] Field of Search ..... 239/106, 112, 239/120, 222.11, 223, 224, 290, 296, 390, 391, 397, 690, 699, 700, 703, 562, 569, 600, DIG. 14; 285/124.3–124.5, 349

[56] References Cited

U.S. PATENT DOCUMENTS

| | | | |
|---|---|---|---|
| 3,224,680 | 12/1965 | Burnside et al. | 239/112 X |
| 4,380,321 | 4/1983 | Culbertson et al. | 239/112 X |
| 4,422,576 | 12/1983 | Saito et al. | 239/703 X |
| 4,936,510 | 6/1990 | Weinstein | 239/290 X |
| 5,100,057 | 3/1992 | Wacker et al. | 239/223 |
| 5,704,977 | 1/1998 | Baumann et al. | 239/390 X |
| 5,727,735 | 3/1998 | Baumann et al. | 239/223 X |
| 5,813,608 | 9/1998 | Yoshioka et al. | 239/112 X |

FOREIGN PATENT DOCUMENTS

| | | |
|---|---|---|
| 3-40388 | 8/1991 | Japan . |
| 4-48820 | 11/1992 | Japan . |
| 5-9146 | 2/1993 | Japan . |
| 5-49976 | 3/1993 | Japan . |
| 6-134354 | 5/1994 | Japan . |
| 6-59423 | 8/1994 | Japan . |
| 6-246200 | 9/1994 | Japan . |
| 7-213957 | 8/1995 | Japan . |
| 7-313908 | 12/1995 | Japan . |

*Primary Examiner*—Andres Kashnikow
*Assistant Examiner*—Steven J. Ganey
*Attorney, Agent, or Firm*—Oblon, Spivak, McClelland, Maier & Neustadt, P.C.

[57] ABSTRACT

A paint spraying apparatus on which a number of paint applicator units of different types can be selectively and replaceably mounted depending upon conditions of a paint coating operation required. A color changing valve assembly is provided in a valve casing which serves as a common base assembly for a number of paint applicator units to be chosen from, including rotary atomizing head type electrostatic paint applicator units and spray gun type electrostatic paint applicator units. Accordingly, depending upon conditions of coating operation, such as shape of a coating surface, nature of paint, properties of solvent etc., a suitable paint applicator unit, selected from the paint applicator units, can be easily and replaceably mounted in position on the valve casing. The color changing valve assembly which is provided within the valve casing can be shared as a common mount base by a plural number of paint applicator units of different types.

17 Claims, 13 Drawing Sheets

PAINT SPRAYING DEVICE

BACKGROUND OF THE INVENTION

1. Field of the invention

This invention relates to a paint spraying apparatus particularly suitable for use, for example, in coating paint on vehicle bodies or the like.

2. Discussion of the Background

Generally, paint spraying apparatus which are in wide use for coating a paint on vehicle bodies or the like are largely constituted by a color changing valve assembly unit which is connected to a multi-color paint source for supplying paint of specified colors selectively from the multi-color paint source, and a paint applicator unit which is connected to the color changing valve assembly unit to spray a paint toward an object to be coated. In a paint spraying apparatus of this sort, in many cases, the paint applicator unit is either mounted on a coating robot or on a reciprocator which is located or installed in a plate remote from the color changing valve assembly, and connected with the latter through a number of paint feed pipes.

In a paint spraying apparatus of this class, for the purpose of enhancing the efficiency of paint deposition on a coating object, a high voltage is applied to the paint applicator unit by the use of a high voltage generator, letting charged paint particles sprayed by the paint applicator unit fly along an electrostatic field which is formed toward the coating object which is retained at the earth potential.

Further, the paint applicator units which are generally used on the paint spraying apparatus of this sort can be classified into a rotary atomizing head type paint applicator unit having a rotary atomizing head which is put in high speed rotation by an air motor to spray a paint supplied from a color changing valve assembly, and a spray gun type paint applicator unit adapted to spray a paint supplied from a color changing valve assembly, along with compressed air or under pressurized air.

Further, the paint applicator units which are in use on the paint spraying apparatus of this sort can also be classified into a straight type paint applicator unit having a housing which is rectilinearly straight in shape for spraying a paint in a straightforward direction and which is suitable for coating surfaces with relatively simple shapes or contours like exterior surfaces of vehicle bodies, and a bend type coating unit having a housing which is angularly bent and suitable for spraying a paint in an angular direction off its axis for coating surfaces with relatively complicate shapes or contours like interior surfaces of vehicle bodies.

In this connection, Japanese Patent Laid-Open No.H6-134354 discloses an electrostatic paint coating apparatus which is generally constituted by a synthetic resin casing, an air motor assembled into the resin casing, a rotary atomizing head mounted at the fore distal end of a rotational shaft of the air motor, and a paint nozzle assembly which can supply paint of different colors to the rotary atomizing head. In this instance, the paint nozzle assembly is provided with a plurality of paint nozzles exclusively for the respective colors which are available, without necessitating the wasting residual paint each time the paint color is changed.

Also disclosed in Japanese Patent Laid-Open No.H7-213957 is an electrostatic paint coating apparatus consisting of a single machine body including an air motor assembled into the machine body, a rotary atomizing head mounted at the fore distal end of a rotational shaft of the air motor, a paint feed pipe for supplying paint to the rotary atomizing head, and a color changing valve mechanism assembled into the machine body in a position on the rear side of the air motor and having a plurality number of paint feed valves in association with a washing valve. In this case, a paint feed passage which connects the paint feed valves with the rotary atomizing head is shortened to minimize the amount of paint which has to be wasted at the time of changing the paint color.

In this regard, of the prior art paint spraying apparatus mentioned above, the paint spraying apparatus which has a color changing valve assembly unit located in a distant place away from a paint applicator unit has an inherent drawback that a large amount of residues of previous color, which remains between the color changing valve assembly unit and the paint applicator unit, has to be wasted and replaced by a paint of new color each time when changing the paint color.

On the other hand, in the case of Japanese Patent Laid-Open No.H6-134354 employing a number of paint nozzles exclusively for the respective colors to be used, there is a problem that a high voltage is always applied not only to a currently selected paint but also to all the paint portions which are standing by within the respective paint nozzles allotted to different colors. As a consequence, under the influence of high voltage, pigments or other components in standing-by portions of paint are caused to separate from solvent and to deposit or sediment within the respective paint nozzles. In some cases, the paint deposits of this sort result in clogging of the paint nozzles. Besides, flakes of paint deposits peeled off and released from walls of paint feed passages could be a cause of serious defects or flaws if they deposit on coated surfaces of products.

In addition, in case it is a metallic paint that is standing by in a paint nozzle, there will arise another problem that coatings are often flawed by the "bridge phenomenon", i.e., electrical shortcutting which occurs to metallic pigments on application of a high voltage.

On the other hand, in case a plurality of paint valves and washing valves are incorporated into a single machine body which is applied with a high voltage as in Japanese Patent Laid-Open No.H7-213957, similarly high voltage is applied not only to a paint of a selected color but also to all the paint portions which are standing by in the respective paint valves. Therefore, similarly to above-mentioned Japanese Patent Laid-Open No.H6-134354, the paint coating apparatus of Japanese Patent Laid-Open No.H7-213957 suffers from the problem of separation and deposition of paint pigments within the respective paint valves under the influence of high voltage.

Further, with paint spraying apparatus which are employed for coating vehicle bodies, it is often the case that a paint applicator unit of either a rotary atomizing head type or a spray gun type is selectively used depending upon conditions of coating operations. For example, a paint applicator unit with a straight housing is generally used when coating exterior surfaces of vehicle bodies, while a paint applicator unit with a bent housing is used for coating interior surfaces of vehicle bodies.

Therefore, it is usually necessary to provide different types of spraying coating units to cope with different conditions of coating operations, and as a result, there is the necessity for providing a large number of component parts which are designed exclusively for the respective paint applicator units of different types, despite degradations in production efficiency and increases in production cost. On the part of users, it has been necessitated to keep a large inventory of spare parts.

In this connection, in the case of an electrostatic paint coating apparatus which has a color changing valve mechanism integrally built into a single machine body as in Japanese Patent Laid-Open No.H7-213957, it is necessary to provide a color changing valve mechanism in each one of various types of paint applicator units, including a plurality of paint feed valves, washing valves and many other component parts. As a result, the construction of each paint applicator unit necessarily becomes complicated, involving an increased number of component parts which will be reflected by degradations in efficiency of assembling work and increases in production cost.

SUMMARY OF THE INVENTION

In view of the above-discussed problems with the prior art, it is an object of the present invention to provide a paint spraying apparatus which is arranged to permit easy replacements of paint applicator unit from one type to another according to conditions of paint coating operations.

In accordance with the present invention, the above-stated objective is achieved by the provision of a paint spraying apparatus, which is essentially constituted by: a valve casing having a plurality of valve mounting bores, along with a paint applicator unit coupling portion provided at the front end thereof; a color changing valve assembly having a plurality of paint valves accommodated in the valve mounting bores in the valve casing to feed paint of various colors selectively to the paint applicator unit; and a plurality of paint applicator units of different types each having an atomizing head for atomizing and spraying a paint supplied from said color changing valve assembly toward a coating object, whereby said paint applicator units being selectively and replaceably connectible to the paint applicator unit coupling portion at the front end of said valve casing depending upon conditions of a required paint coating operation, using the valve casing as a common mount base.

With the arrangements just described, a color changing valve assembly can be constituted by a plurality of paint valves which are allotted to paint of different colors and accommodated in valve mounting bores formed in one valve casing. In addition, various types of paint applicator units can be selectively and replaceably mounted on the valve casing depending upon conditions of required paint coating operations. In so doing, the valve casing and the color changing valve assembly within the valve casing are shared as common components by the respective paint applicator units, permitting one to change the paint applicator unit quickly, for example, to cope with alterations in conditions of coating operations.

In this instance, according to the present invention, the paint applicator units may include a rotary atomizing head type paint applicator unit having a rotary atomizing head to be put in high-speed rotation by an air motor to atomize a paint supplied from the color changing valve assembly, and a spray gun type paint applicator unit having a paint nozzle for spraying a paint supplied from the color changing valve assembly, both of the rotary atomizing head type paint applicator unit and the spray gun type paint applicator unit being selectively and detachably connectible to the valve casing.

With the arrangements just described, the paint applicator unit can be easily changed from a rotary atomizing head type to a spray gun type or vice versa, for example, according to conditions of coating operation such as the shape or nature of a coating object or the kind of paint.

Further, according to the present invention, the paint applicator units may include a straight type paint applicator unit having a straight housing to spray a paint supplied from the color changing valve assembly axially in a straightforward direction, and a bent type paint applicator unit having an angularly bent housing for spraying paint supplied from the color changing valve assembly in a direction off the axis of the valve casing, either one of the straight and bent type paint applicator units being selectively and detachably connectible to the valve casing.

With the arrangements just described, it becomes possible to use interchangeably a straight type paint applicator unit and a bent type paint applicator unit, for example, to use a straight type paint applicator unit for a paint coating operation on exterior surfaces of a vehicle body and a bent type paint applicator unit for a paint coating operation on interior surfaces of a vehicle body, if desired.

Further, according to the present invention, the paint applicator units may include a low output voltage type paint applicator unit incorporating a low output type high voltage generator to produce a relatively low output voltage, and a high output voltage type paint applicator unit incorporating a high output type high voltage generator to produce a relatively high output voltage, both of the low and high output type paint applicator units being selectively and detachably connectible to the valve casing.

With the arrangements just described, both a low output type paint applicator unit and high output type paint applicator unit can be interchangeably employed according to the kind or properties of a paint to be used.

On the other hand, according to a preferred form of the present invention, an annular clamp member is provided at the front end of the valve casing, thereby detachably coupling various paint applicator units with the valve casing.

With the arrangements just described, at the time of replacement, a paint applicator unit can be easily coupled with the valve casing or detached therefrom simply by tightening or loosening the clamp member.

Further, according to the present invention, the paint applicator unit is equipped with a built-in high voltage generator for electrically charging sprayed paint particles, and an atomizing head of the paint applicator unit is communicated with a paint supply passage of the color changing valve assembly through a spiral tube, thereby retaining the color changing valve assembly in the valve casing on the lower voltage side of the high voltage generator.

With the arrangements just described, when a high voltage is applied by the high voltage generator to a paint to be coated on, the applied voltage is caused to undergo voltage reductions through the spiral tube to retain the valve casing (color changing valve assembly) on the lower voltage side. As a result, the valve casing is retained on the lower voltage side of the high voltage generator, which can be regarded as earth potential, thereby preventing separation of pigments in stand-by paint portion which is filled in the color changing valve assembly.

Further, according to another aspect of the present invention, the color changing valve assembly includes a plurality of paint valves allotted to different paint colors and accommodated in said valve mounting bores in said valve casing, a common paint passage intercommunicating said paint valves, and a washing valve which is located at the upstream end of the common paint passage to supply flushing air and thinner through the common paint passage.

With the arrangements just described, paint of various colors can be selectively supplied to a paint applicator unit from the respective paint valves through the common paint passage, thereby opening the washing valve at the time of changing the paint color to supply flushing air and thinner to the entire common paint passage for washing away paint of previous color before supplying a fresh color therethrough.

According to a further aspect of the present invention, the paint applicator unit is a rotary atomizing head type paint applicator unit, and a nose end washing valve is accommodated in a valve mounting bore in the valve casing and opened to supply flushing thinner to fore end portions of a paint passage in the paint applicator unit at the time of washing a nose end portion thereof.

With the arrangements just described, the nose end washing valve is opened when it becomes necessary to change the paint with a color, for supplying flushing thinner to fore end portions of a paint passage in a paint applicator unit to wash away paint of previous color from nose end portions of the paint applicator unit.

DISCUSSION OF THE PREFERRED EMBODIMENTS

Hereafter, the paint spraying apparatus according to the present invention is described more particularly by way of its preferred embodiments with reference to accompanying drawings.

Figure 1:
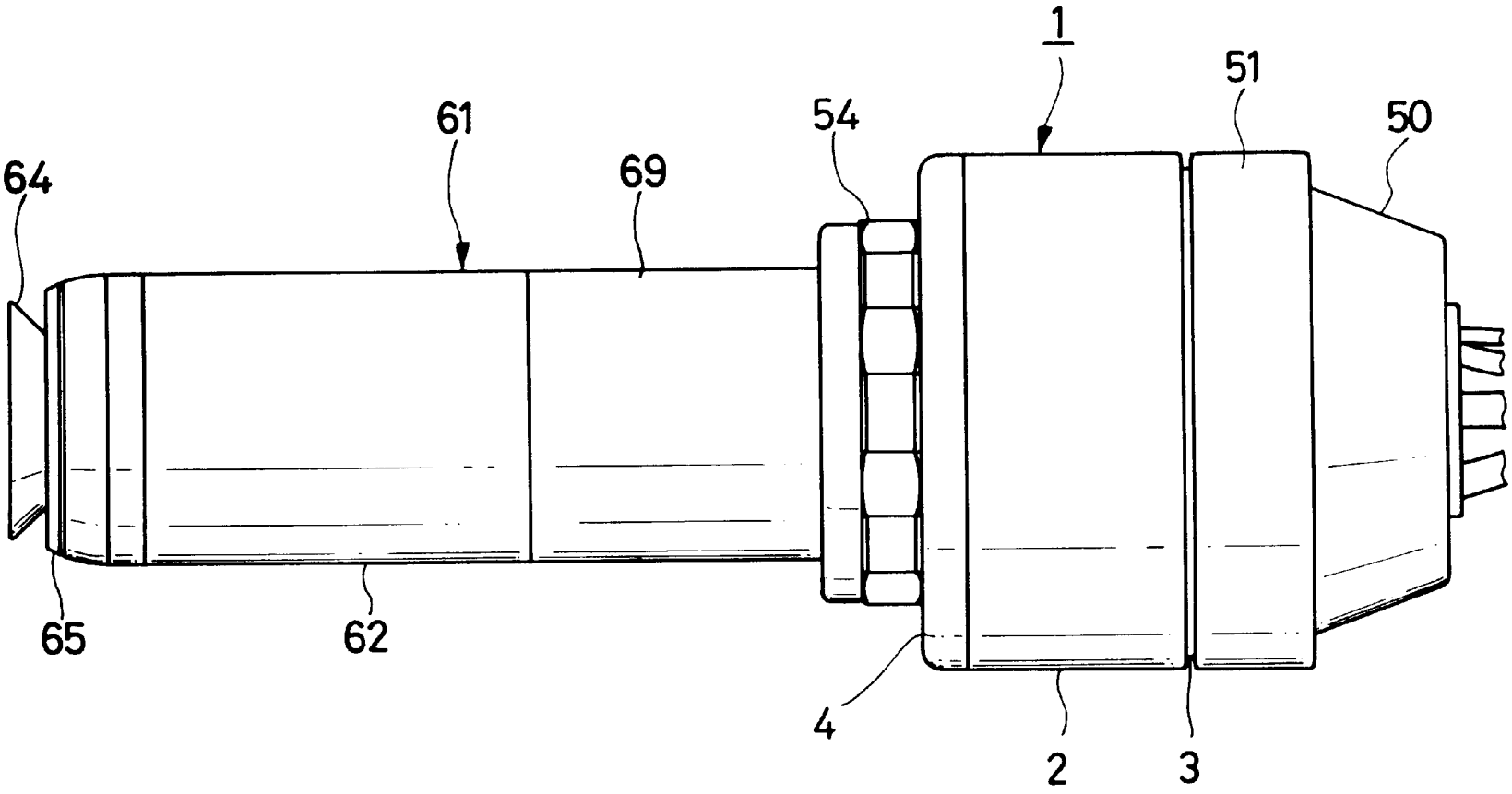
FIG. 1 is a front view of a straight rotary atomizing head type electrostatic paint applicator unit, which is mounted on a valve casing.
Figure 2:
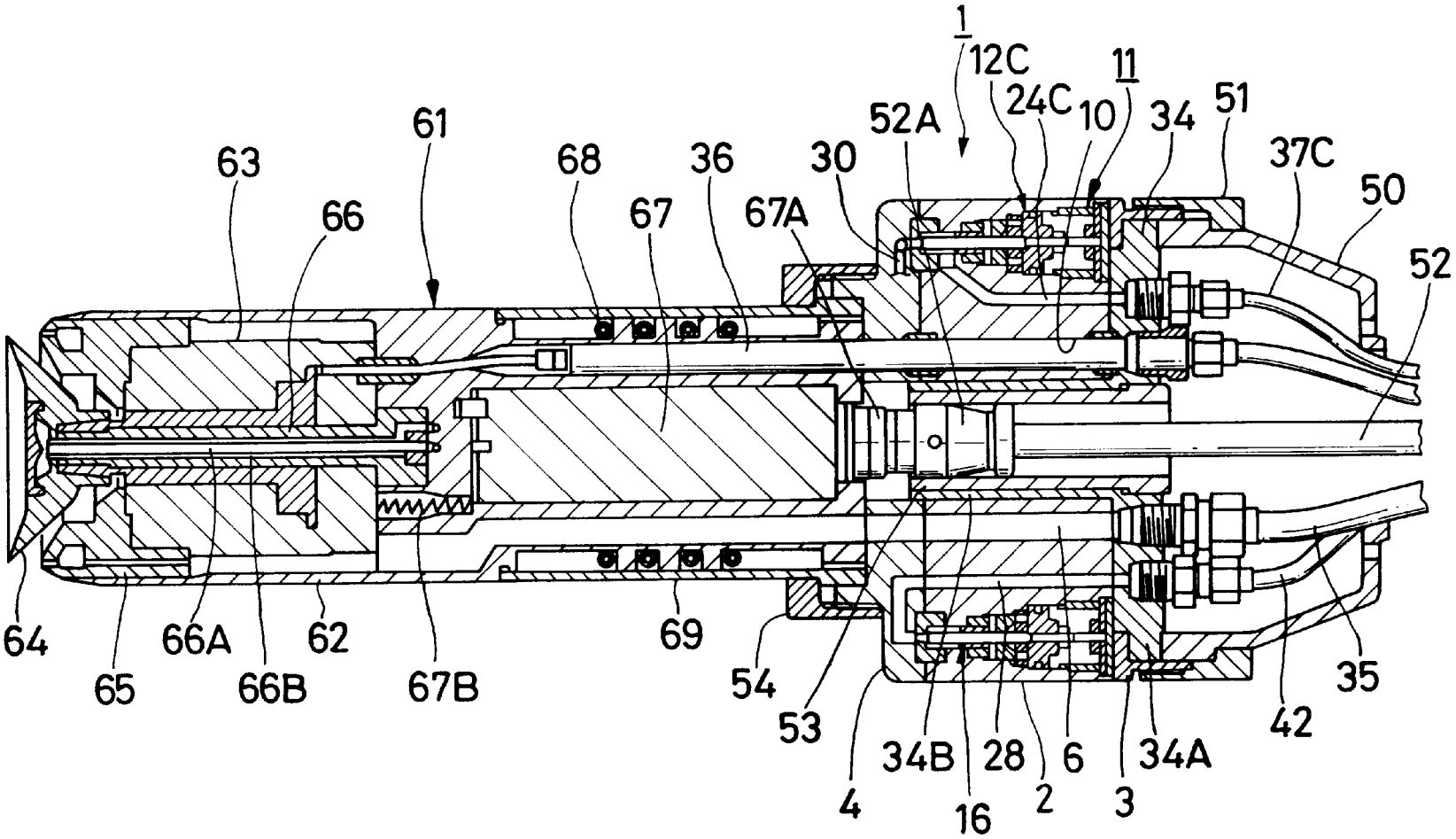
FIG. 2 is a vertical sectional view of the straight rotary atomizing head type electrostatic paint applicator unit shown in FIG. 1.

In the drawings, indicated at 1 is a valve casing which serves as a base platform of a paint spraying apparatus. As seen in FIG. 2, the valve casing 1 is largely constituted by an annular casing body 2, a connector ring 3 and a front plate 4 as will be described in greater detail below.

Figure 3:
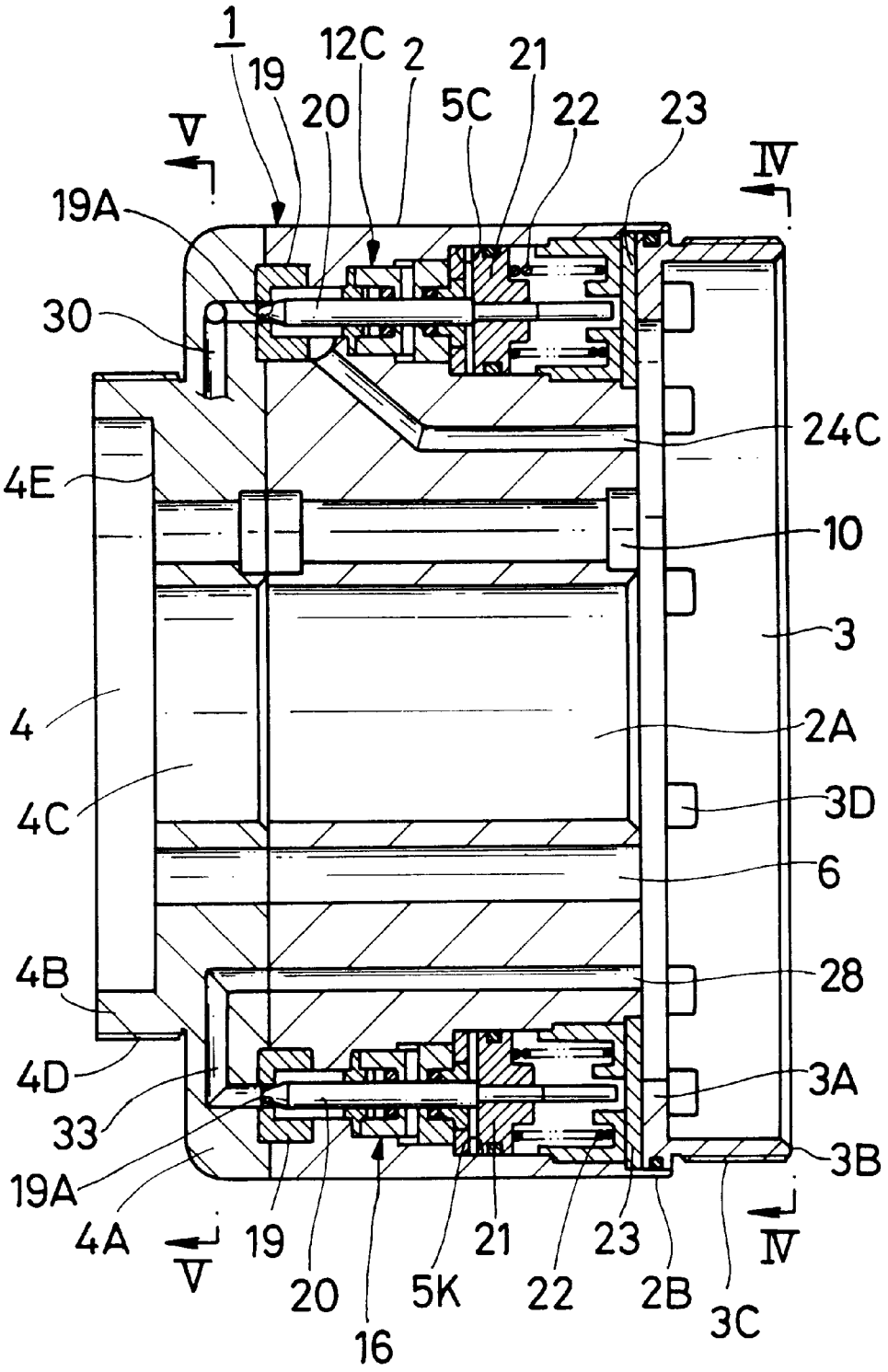
FIG. 3 is a sectional view on an enlarged scale of the valve casing shown in FIG. 2, accommodating a color changing valve assembly therein.

As shown in FIG. 3, the annular casing body 2, which constitutes a base portion of the valve casing 1, is formed with an annular shape and centrally provided with a cylindrical through hole 2A which serves as a cable passage. Axially projected from one end of the annular casing body 2 is an annular sleeve portion 2B for fitting engagement with an annular disc 3A of the connector ring 3.

Reference numeral 3 denotes the connector ring which is provided at one end of the annular casing body 2, the connector ring 3 being constituted by the annular disc 3A, which is fitted in the sleeve portion 2B of the annular casing body 2, a tubular projection 3B which is axially projected from the annular disc 3A on the side away from the annular casing body 2, and a screw portion 3C which is tapped on the outer periphery of the tubular projection 3B. The annular disc 3A of the connector ring 3 is securely fixed to the annular casing body 2 by means of bolts 3D.

Reference numeral 4 denotes the front plate which is mounted on the front end face of the annular casing body 2 for mounting a paint applicator unit, the front plate 4 being formed in the shape of a stepped disc having a larger diameter portion 4A and a small diameter portion 4B and centrally bored with a cable passage hole 4C in the same diameter as the cable passage hole 2A in the annular casing body 2. Further, the front plate 4 is provided with a screw portion 4D on the outer periphery of the small diameter portion 4B. Provided on the inner peripheral side of the small diameter portion 4B is a stepped socket 4E in which one of paint applicator units 61, 71, 81, 101, 111, 112 and so forth is selectively and replaceably mounted in the manner as will be described in greater detail hereinafter. Thus, the front plate 4 constitutes a common mount base for a number of paint applicator units.

Figure 4:
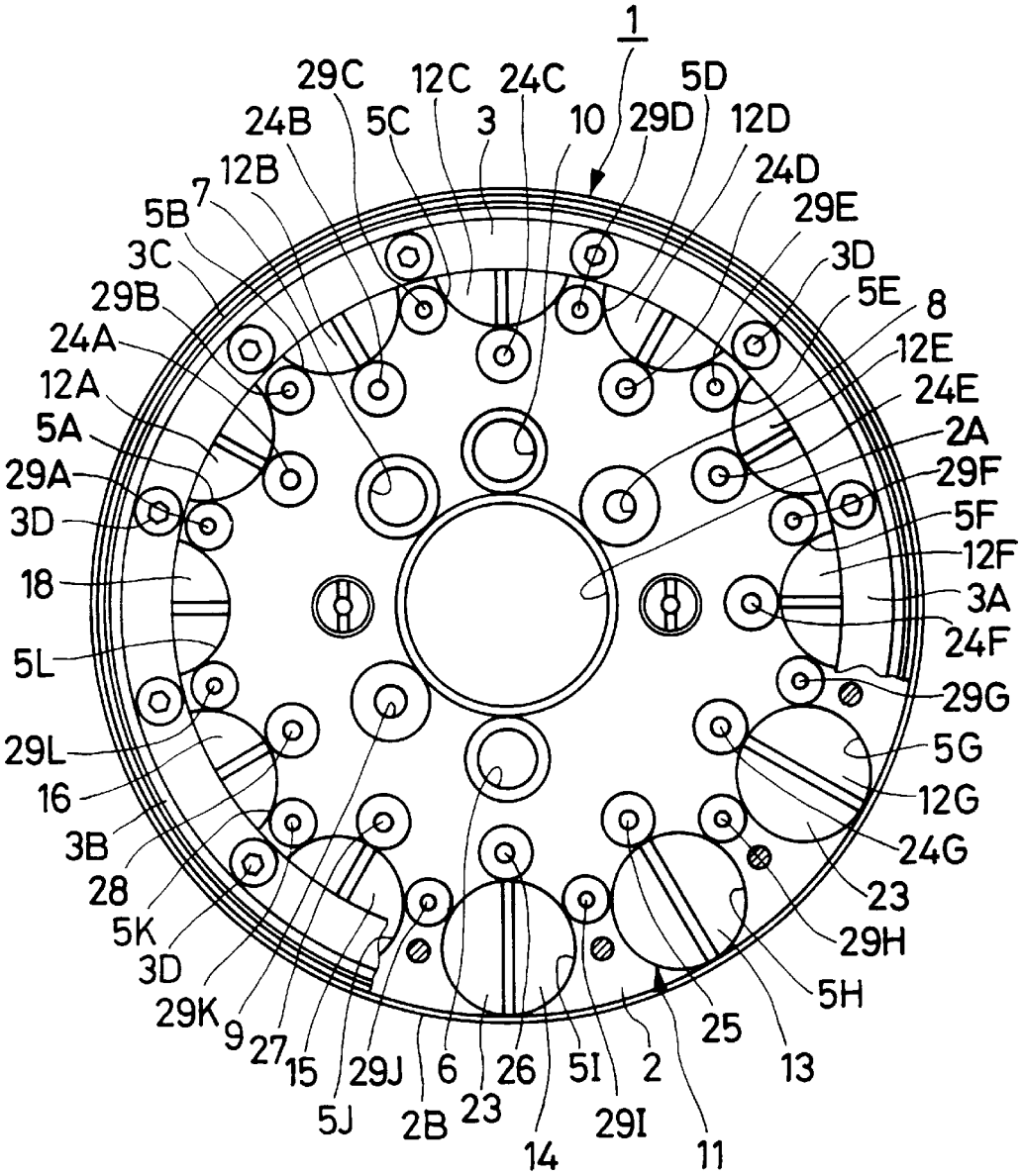
FIG. 4 is a partly cutaway right-hand end view of the valve casing of FIG. 3, taken in the direction of arrows IV—IV.

In this particular embodiment, as shown in FIG. 4, the annular casing body 2 is provided with twelve valve mounting bores 5A, 5B, 5C . . . 5L which are arranged circularly in spaced positions along the outer periphery thereof. Received in the valve mounting bores 5A to 5L are valves 12A to 12G, 13, 14, 15, 16 and 18 as will be described hereinlater.

Provided along the inner periphery of the annular casing body 2 are: a shaping air passage 6 for sending therethrough pressurized air for shaping paint spray patterns; a driving air passage 7 for sending therethrough pressurized air for driving an air motor turbine 63C of air motor 63; a brake air passage 8 for sending braking air to be applied to the air turbine 63C; a bearing air passage 9 for sending air to an air bearing (not shown) of the air motor 63; and a cable passage 10 for passing a detector cable to be connected to a rotational speed detector (not shown) which is provided for detection of rotational speed of the air turbine 63C. All of these passages, i.e., shaping air passage 6, driving air passage 7, brake air passage 8, bearing air passage 9, cable passage 10, are connected to corresponding passages on the part of s paint applicator unit 61, 71, 81, 101, 111 or 112 through the annular casing body 2.

The valve casing 1, which is arranged in the above-described manner, is connected to the earth potential oppositely to a high output type high voltage generator 67 which will be described hereinafter. The connector ring 3 is fixedly mounted on a distal end portion of a coating robot arm (not shown) through rear plate 34, holder 50 etc. A suitable one of the paint applicator units 61, 71, 81, 101, 111 and 112 is selectively mounted on the front plate 4 at the fore end of the valve casing 1.

Indicated at 11 is a color changing valve assembly which is built into the valve casing 1 and which includes paint valves 12A to 12G, paint supply valve 13 and washing gate valve 14 as will be described in greater detail hereinafter.

The paint valves 12A to 12G are accommodated in the valve mounting bores 5A to 5G to supply paint of different colors A to G, respectively. Paint of a selected color is supplied to the paint applicator unit 61 from one of these paint valves 12A to 12G through a common paint passage 30 and a paint passage 31 which will be described hereinafter.

The paint supply valve 13, which is accommodated in the valve mounting bore 5H, functions to turn on and off paint supply to the paint applicator unit 61 from another color changing valve assembly 44 which will be described hereinafter.

The washing gate valve 14, which is accommodated in the valve mounting bore 5I, is connected to an air source 45 and a thinner source 46 respectively through an air valve 48 and a thinner valve 49 which will be described hereinafter. At the time of changing the paint color, this washing gate valve 14 is opened to supply flushing air and thinner to the common paint passage 30 and paint passage 31 as well as to feed tube 66 and spiral tube 68, which will be described hereinafter, thereby washing away residual paint of previous color from these passages prior to supplying a paint of a newly selected color.

In a paint coating operation, the paint applicator unit 61, 71, 81, 101, 111 or 112 is supplied with a paint of a color selected from paint colors A to G from the color changing valve assembly 11, or with a paint which is supplied from the other paint color changing valve assembly 44, by opening or closing the paint valves 12A to 12G and trigger valve 18. The washing gate valve 14 is opened at the time of changing the paint color to supply flushing air and thinner to the common paint passage 30, paint passage 31, spiral tube 68 and feed tube 66, thereby washing away residual paint of previous color from these passages as described above.

Further, a nose end washing valve 15 is accommodated in the valve mounting bore 5J. When this nose end washing valve 15 is opened, a thinner is supplied to the feed tube 66 for washing distal end portions of the latter.

Denoted at 16 is a discharge valve (dump valve) which is accommodated in the valve mounting bore 5K and which is connected to the paint supply valve 13 through an intercommunicating passage 17. When changing the paint to a new color instead of a color which has been supplied from the other color changing valve assembly 44 to the paint supply valve 13, this discharge valve 16 is opened to dump the paint of previous color into a sump or waste liquor tank 47 which will be described hereinafter.

The reference numeral 18 indicates the trigger valve which is accommodated in the valve mounting bore 5L. This trigger valve 18 serves to turn on and off the supply of paint from the common paint passage 30 to the paint applicator unit 61 or the like.

In this instance, all of the above-mentioned paint valves 12A to 12G, paint supply valve 13, washing gate valve 14, nose end washing valve 15, discharge valve 16 and trigger valve 18 are similar to each other in construction. Namely, each one of the paint valves 12A to 12G, paint supply valve 13, washing gate valve 14, nose end washing valve 15, discharge valve 16 and trigger valve 18 is largely constituted by: a valve seat member 19 which is fitted in a fore end portion of the valve mounting bore 5A to 5L; a needle valve body 20 which opens and closes a flow passage 19A in the valve seat 19; a piston 21 which is attached to a base end portion of the needle valve body 20 for axial sliding movements within the valve mounting bore 5A to 5L; a biasing spring member 22 which constantly urges the needle valve body 20 in a valve closing direction through the piston 21; and a cap 23 which closes one end of the valve mounting bores 5A to 5L.

Namely, each one of the paint valves 12A to 12G, washing gate valve 14, nose end washing valve 15, discharge valve 16 and trigger valve 18 is in the form of a 2-port 2-position on-off valve for opening and closing the flow passage 19A in the valve seat 19. On the other hand, the paint valve 13 is arranged as a 3-port 2-position change-over valve for connecting a paint supply passage 25, which will be described hereinafter, selectively with either the common paint passage 30 or the intercommunicating passage 17 according to the position of the needle valve body 20.

Figure 5:
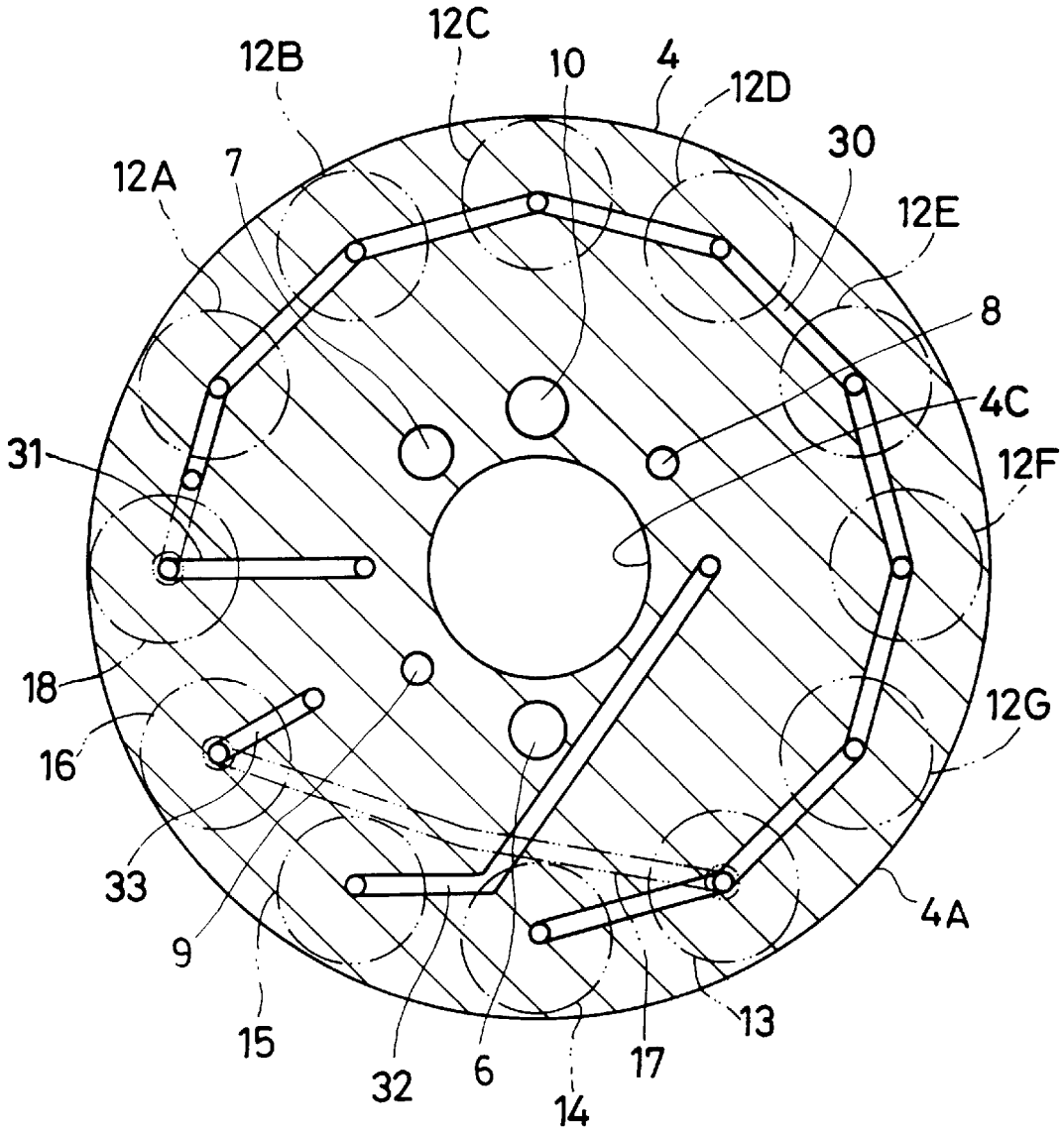
FIG. 5 is a cross-sectional view of a front plate shown in FIG. 3, taken in the direction of arrows V—V.

Further, as seen in FIGS. 4 and 5, the valve casing 1 contains various passages to communicate with each other the above-described paint valves 12A to 12G, paint supply valve 13, washing gate valve 14, nose end washing valve 15, discharge valve 16 and trigger valve 18.

More specifically, indicated at 24A to 24G are paint supply passages which are located in the proximity of the valve mounting bores 5A to 5G, respectively, and which are exclusively allotted to paint colors A to G which are frequently used in paint coating operations. These paint supply passages 24A to 24G are separately connected to paint sources 43A to 43G of colors A to G through separate paint feed pipes 37A to 37G, respectively.

Indicated at 25 is a paint supply passage which is provided in the proximity of the valve mounting bore 5H to supply a color which is used less frequently. This paint supply passage 25 is connected to the other or alternative color changing valve assembly 44 through another paint feed pipe 38.

Indicated at 26 is an air/thinner supply passage which is provided in the proximity of the valve mounting bore 5I to supply flushing air and thinner to the common paint passage 30 for washing away a previously used paint color therefrom. The air/thinner passage 26 is connected to an air source 45 and a thinner source 46 through air feed pipe 39 and air valve 48 and through thinner feed pipe 40 and thinner valve 49, respectively.

The reference numeral 27 indicates a thinner supply passage which is provided in the proximity of the valve mounting bore 5J to supply thinner for washing nose end portions of rotary atomizing head 64 and feed tube 66. This nose end washing thinner supply passage 27 is connected to the thinner source 46 through a thinner feed pipe 41.

The reference numeral 28 denotes a discharge passage which is provided in the proximity of the valve mounting bore 5K to pass on the waste of previous color paint and thinner which are discharged through the other paint feed pipe 38 and paint supply passage 25. This discharge passage 28 is connected to the waste liquor tank 47 through a discharge pipe 42.

Indicated at 29A to 29L are pilot air passages which convey pilot air for operating the paint valves 12A to 12G, paint supply valve 13, washing gate valve 14, nose end washing valve 15, discharge valve 16 and trigger valve 18. These pilot air supply passages 29A to 29L are connected to pilot air valves (none of which is shown in the drawings) through pilot air pipings.

Further, the front plate 4 is provided with a number of passages for detachably connecting the paint valves 12A to 12G, paint supply valve 13, washing gate valve 14, nose end washing valve 15, discharge valve 16 and trigger valve 18 in the valve casing 1 with the paint applicator unit 61 or the like, in the manner as described below.

More specifically, the front plate 4 contains the common paint passage 30 which constitutes the color changing valve assembly 11 along with the paint valves 12A to 12G, paint supply valve 13 and washing gate valve 14. This common paint passage 30 serves to communicate the respective valves 12A to 12G, 13 and 14 with each other. For this purpose, as shown in FIG. 5, the common paint passage 30 is arranged to intercommunicate successively the washing gate valve 14, paint supply valve 13, paint valves 12G to 12A and trigger valve 18 from an upstream side to a downstream side thereof.

Indicated at 31 is a paint passage which is formed in the front plate 4. This paint passage 31 is connected to the trigger valve 18 at its upstream end and communicated with a spiral tube 68 at its downstream end.

Designated at 32 is a thinner passage which is formed in the front plate 4. This thinner passage 32 is connected to the nose end washing valve 15 at its upstream end and communicated with a thinner feed passage 66B of the feed tube 66 at its downstream end.

Indicated at 33 is an intercommunicating passage which is formed likewise in the front plate 4 to intercommunicate the discharge valve 16 and discharge passage 28.

Located on the rear side of the annular casing body 2 is a rear plate 34, which is largely constituted by a plate portion 34A which is positioned within the sleeve portion 3B of the connector ring 3 in abutting engagement with the rear end face of the annular casing body 2, and a sleeve portion 34B which is axially projected from the center of the plate portion 34A to extend into the cable passage hole 2A of the annular casing body 2.

Figure 6:
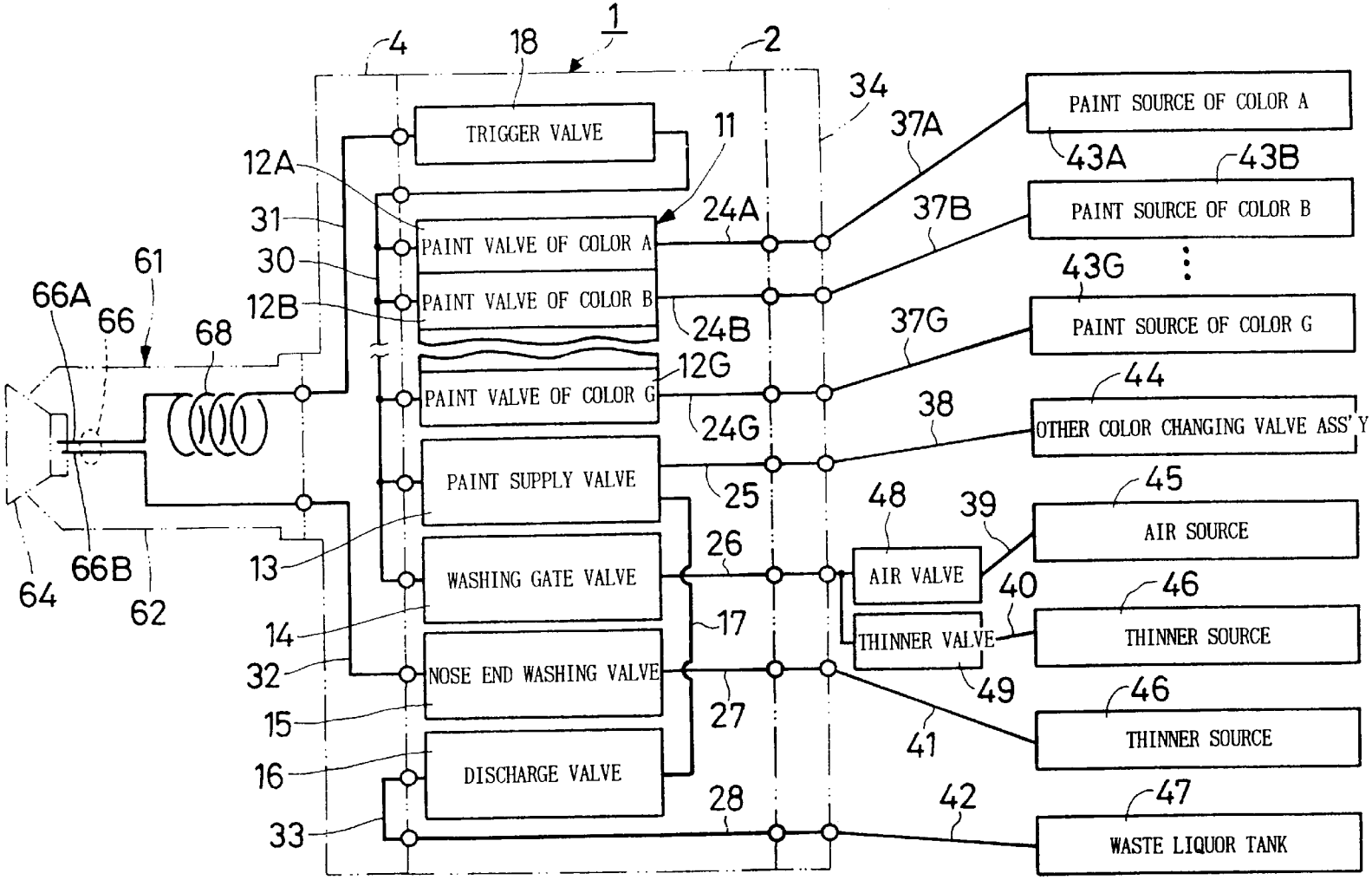
FIG. 6 is a circuit diagram illustrative of the general layout of a paint spraying apparatus.

In this particular embodiment, as shown in FIG. 2 or 6, the plate portion 34A of the rear plate 34 is provided with connection ports to make connections with: a shaping air feed pipe 35 to be communicated with the shaping air passage 6; a detection cable 36 to be passed through the cable passage hole 10; paint feed pipes 37A to 37G of colors A to G to be communicated with the paint supply passages 24A to 24G, respectively; another paint feed pipe 38 to be communicated with the paint supply passage 25; an air feed pipe 39 and a thinner feed pipe 40 to be communicated with the air/thinner supply passage 26; a thinner feed pipe 41 to be communicated with the nose end washing thinner supply passage 27; and a discharge pipe 42 to be communicated with the discharge passage 28.

The above-described paint feed pipes 37A to 37G are connected to paint sources 43A to 43G of different colors A to G, respectively. The other paint feed pipe 38 is connected to the other color changing valve assembly 44 which selectively supplies a paint of a less frequently used color. The air feed pipe 39 is connected to the air source 45, while the thinner feed pipes 40 and 41 are connected to the thinner source 46. Further, the discharge pipe 42 is connected to the waste liquor tank 47.

In this instance, an air valve 48 is provided within the length of the air feed pipe 39 to turn on and off the supply of air from the air source 45 to the washing gate valve 14. Likewise, a thinner valve 49 is provided within the length of the thinner feed pipe 40 for turning on and off the supply of thinner from the thinner source 46 to the washing gate valve 14.

Further, (although not shown in the drawings,) the rear plate 34 is provided with connection ports which are connectible with a pilot air feed pipe to be communicated with the pilot air supply passages 29A to 29L, a driving air feed pipe to be communicated with the driving air passage 7, a braking air feed pipe to be communicated with the brake air passage 8, and a bearing air feed pipe to be communicated with the bearing air passage 9.

Indicated at 50 is a holder for mounting the valve casing 1 on a coating robot arm. As shown in FIG. 2, together with the rear plate 34, the holder 50 is securely fixed to the valve casing 1 by means of nuts 51.

Designated at 52 is a power supply cable which is located centrally within the valve casing 1, the power supply cable 52 having a connector 52A which is supported in a connector coupling sleeve 53 which is in turn fixed within the sleeve portion 34B of the rear plate 34. This power supply cable 52 supplies electric power to a high output type high voltage generator 67 or the like as will be described hereinafter.

The paint applicator unit 61 is detachably mounted on the front plate 4 of the valve casing 1 in the manner as described below.

Indicated at 54 is a setting nut which is provided on the side of the paint applicator unit, namely, a clamp member which is fixable on a screw portion 4D on the front side of the front plate 4 through threaded engagement therewith. The other front end of the setting nut 54 which is provided on the part of the paint applicator unit, is projected in a radially inward direction to form a stepped portion 54A. The setting nut 54 of the paint applicator unit 61 is tightly threaded on the screw portion 4D of the front plate 4, thereby holding base end portions of the tube cover 69 in fitting engagement with the stepped socket portion 4E of the front plate 4 along with rear end portions of the paint applicator unit 61. Thus, the paint applicator unit 61 is integrally fixed to the valve casing 1, with the stepped portion 54A of the setting nut 54 of the paint applicator unit in abutting engagement with a stepped portion 69A of the tube cover 69.

The straight rotary atomizing head type electrostatic paint applicator unit 61, which is detachably mounted at the front end of the valve casing 1 in this particular embodiment, is arranged in the manner as follows. Namely, as will be described below, this rotary atomizing head type electrostatic paint applicator unit 61 is largely constituted by a housing 62, an air motor 63, a rotary atomizing head 64, a shaping air ring 65, a feed tube 66 and a high output type high voltage generator 67.

Figure 7:
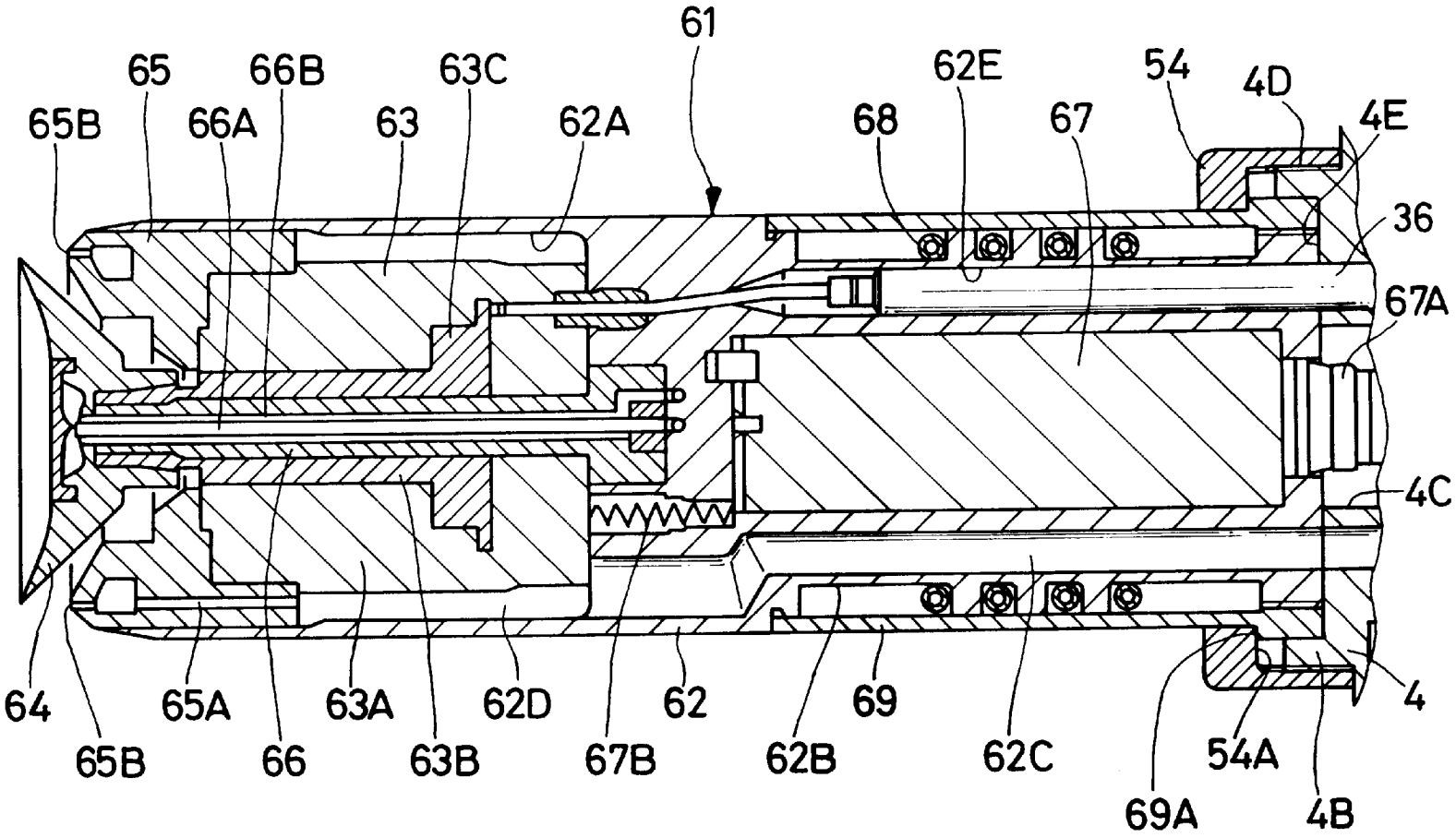
FIG. 7 is a vertical section on an enlarged scale of the rotary atomizing head type electrostatic paint applicator unit shown in FIG. 2.

Indicated at 62 is the housing which is arranged to wrap in the air motor 63 and high voltage generator 67. As seen in FIG. 7, the housing 62 is formed in a stepped cylindrical shape defining a motor room 62A in a front end portion to accommodate the air motor 63. Between an axially mid point and the rear end on the side of the front plate 4, the circumferential surface of the housing 62 is sunk to provide tube winding portions 62B. Further, the housing 62 is internally provided with a first shaping air passage 62C which is in communication with the shaping air passage 6 on the part of the valve casing 1 at one end thereof, and a second shaping air passage 62D which is formed in the outer peripheral portions of the motor chamber 62A around the air motor 63. Furthermore, the housing 62 is provided with a cable passage hole 62E for the detection cable 36, along with driving air passage, brake air passage and bearing air passage (which are not shown in the drawings).

The reference numeral 63 denotes the air motor which is accommodated in the motor room 62A of the housing 62. This air motor 63 is largely constituted by: a motor housing 63A; a hollow rotational shaft 63B which is rotatably supported through an air bearing within the motor housing 63A; and an air turbine 63C which is fixedly mounted on a base end portion of the rotational shaft 63B. The air turbine 63C of the air motor 63 is driven by air which is supplied through the driving air passage 7 to put the rotational shaft 63B in high speed rotation.

Indicated at 64 is an atomizing head, more specifically, a bell type rotary atomizing head which is mounted at the fore end of the rotational shaft 63B of the air motor 63. The rotary atomizing head 64 is put in high speed rotation, so that a paint which is fed thereto through the feed tube 66 is sprayed in atomized particles from marginal edges of the rotary atomizing head under the influence of centrifugal force.

Denoted at 65 is a shaping air ring which is provided in a front end portion of the housing 62 in such a way as to circumvent the rotary atomizing head 64. The shaping air ring 65 is provided with a shaping air passage 65A which is in communication with the second shaping air passage 62D in the housing 62, and a plurality of air outlet holes 65B to spurt shaping air, which is supplied through the shaping air passage 65A, toward paint particles which are being sprayed from the rotary atomizing head 64.

Denoted at 66 is a feed tube which is passed through the hollow rotational shaft 63B of the air motor 63. This feed tube 66 contains a paint supply passage 66A which is axially extended in a core portion of the tube, and a thinner supply passage 66B which is formed along and around the paint supply passage 66A. The paint supply passage 66A is communicated with the paint passage 31 and common paint passage 30 in the valve casing 1 through a spiral tube 68, while the thinner supply passage 66B is communicated with the thinner supply passage 32.

Designated at 67 is the high output type high voltage generator which is built into a rear end portion of the housing 62. The high voltage generator 67 is provided with a connector 67A on its low voltage side (grounded side). This connector 67A is coupled with a connector 52A of the power supply cable 52. On the other hand, the high voltage side (output side) of the high voltage generator 67 is electrically connected to the air motor housing 63A through a lead spring 67B. In this instance, although not shown in the drawings, the high voltage generator 67 is constituted by a multi-stage voltage doubler rectifier circuit (Cockcroft circuit), which consists of a plural number of capacitors, diodes etc., thereby transforming the source voltage, supplied through the power supply cable 52, to a predetermined high voltage level, for example, to a voltage of from −90 kv to −120 kv. Through the air motor 63 and feed tube 66, this high voltage is applied to the paint which is flowing through the paint supply passage 66A.

Indicated at 68 is the spiral tube which is provided on the outer periphery of the tube winding portion 62B of the housing 62. The spiral tube 68 is wound around the outer periphery of the tube winding portion 62B, with its one end in communication with the common paint passage 30 and paint passage 31, and the other end in communication with the paint supply passage 66A of the feed tube 66. Thus, the spiral tube 68 serves to increase the flow distance of paint, that is to say, to increase the electrical resistance between the high voltage generator 67 and the color changing valve assembly 11. As a result, the high voltage which is applied to the paint by the high voltage generator 67 undergoes drops in voltage while flowing through the spiral tube 68, to maintain the valve casing 1 (color changing valve assembly 11) on the lower voltage side. Besides, the spiral tube 68 serves to suppress the so-called "bridging" phenomenon which might take places when coating a metallic paint.

Indicated at 69 is a tube cover which is fitted on the housing 62 in such a manner as to wrap in the tube winding portion 62B. The tube cover 69 is provided for the protection of the spiral tube 68 which is wound around the tube winding portion 62B, and formed in a cylindrical shape. Further, the tube cover 69 is provided with a stepped portion 69A which is projected radially outward from its outer periphery at one end thereof for engagement with a stepped portion 54A of the setting nut 54.

In this embodiment, the paint applicator unit 61 is attached to or detached from the front plate 4 by tightening or loosening the setting nut 54 on the side of the paint applicator unit.

Figure 8:
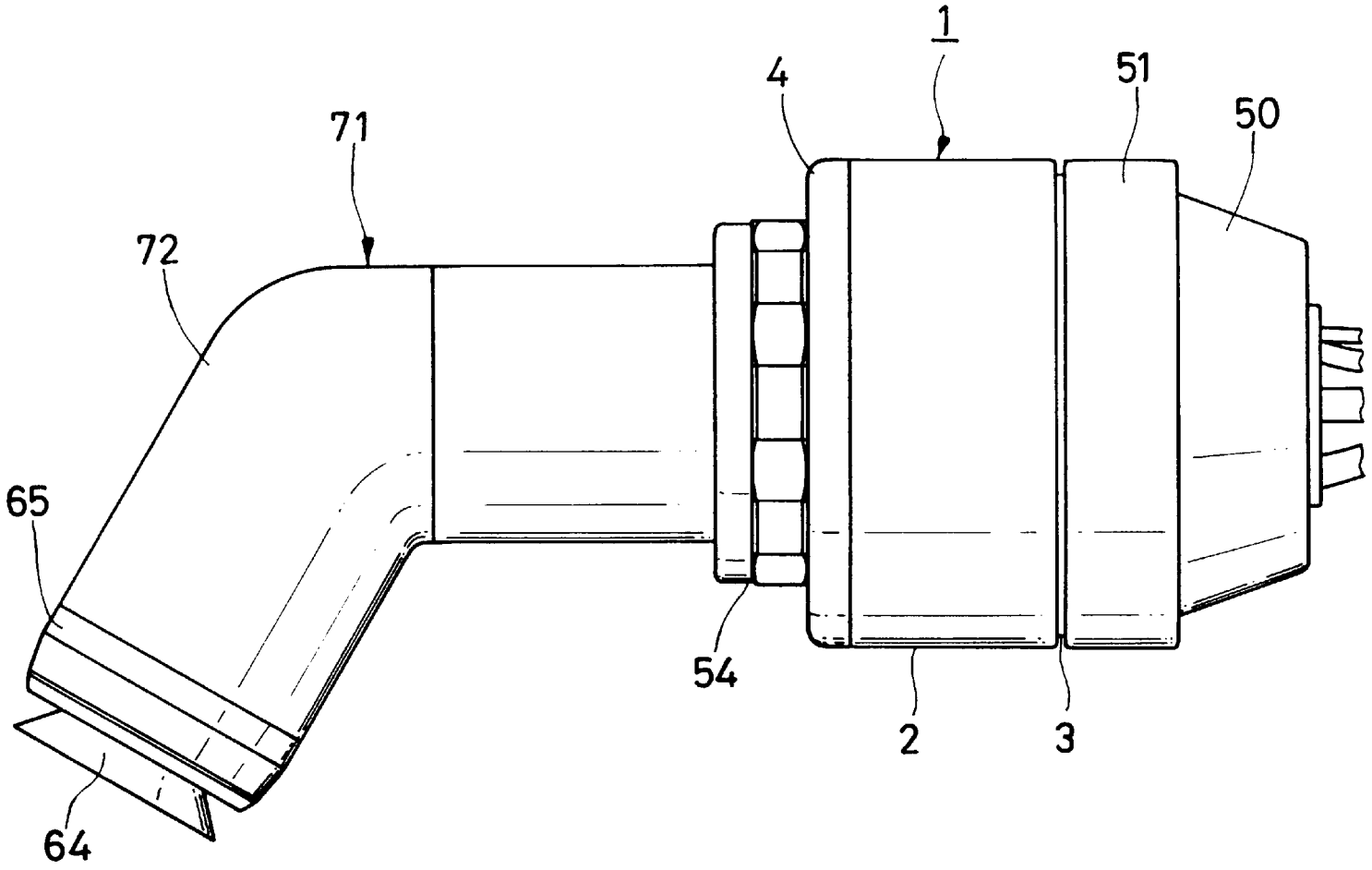
FIG. 8 is a front view of a bent rotary atomizing head type electrostatic paint applicator unit, as is mounted on the valve casing, taken in the same direction as in FIG. 1.

Turning now to FIG. 8, there is shown a bent rotary atomizing head type electrostatic paint applicator unit which is detachably mounted on the valve casing 1 instead of the above-described straight rotary atomizing head type electrostatic paint applicator unit 61.

More specifically, indicated at 71 is a bent rotary atomizing head type electrostatic paint applicator unit which is detachably attached to the front end of the valve casing 1. This rotary atomizing head type paint applicator unit 71 has a housing 72 which is bent at an angle of about 60 degree with the axis of the paint applicator unit 71. This angular arrangement is suitable, for example, for coating a paint on interior surfaces of a vehicle body, permitting to bring the paint applicator unit into the vehicle body through a window frame or the like for coating surfaces with complicate shapes or contours whenever necessary.

Except for the housing 72, the bent rotary atomizing head type electrostatic paint applicator unit 71 is constituted by component parts which are common with the above-described straight rotary atomizing head type electrostatic paint applicator unit 61, including the air motor, rotary atomizing head, shaping air ring, feed tube, high output type high voltage generator, tube cover etc. Accordingly, the common component parts are simply designated by common reference numerals or characters to avoid repetition of same explanations.

Figure 9:
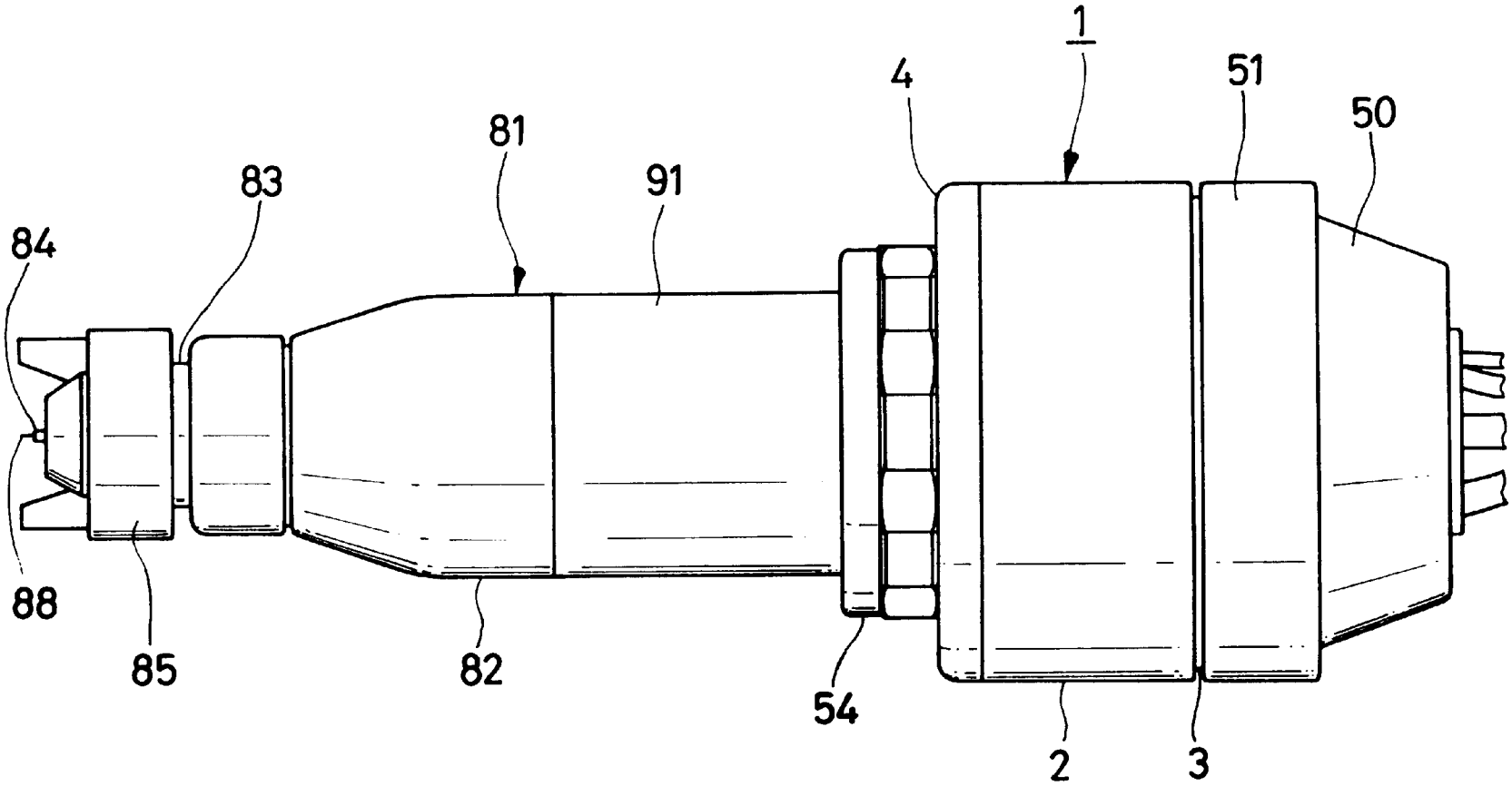
FIG. 9 is a front view of a straight spray gun type electrostatic paint applicator unit, as mounted on the valve casing, taken in the same direction as in FIG. 1.
Figure 10:
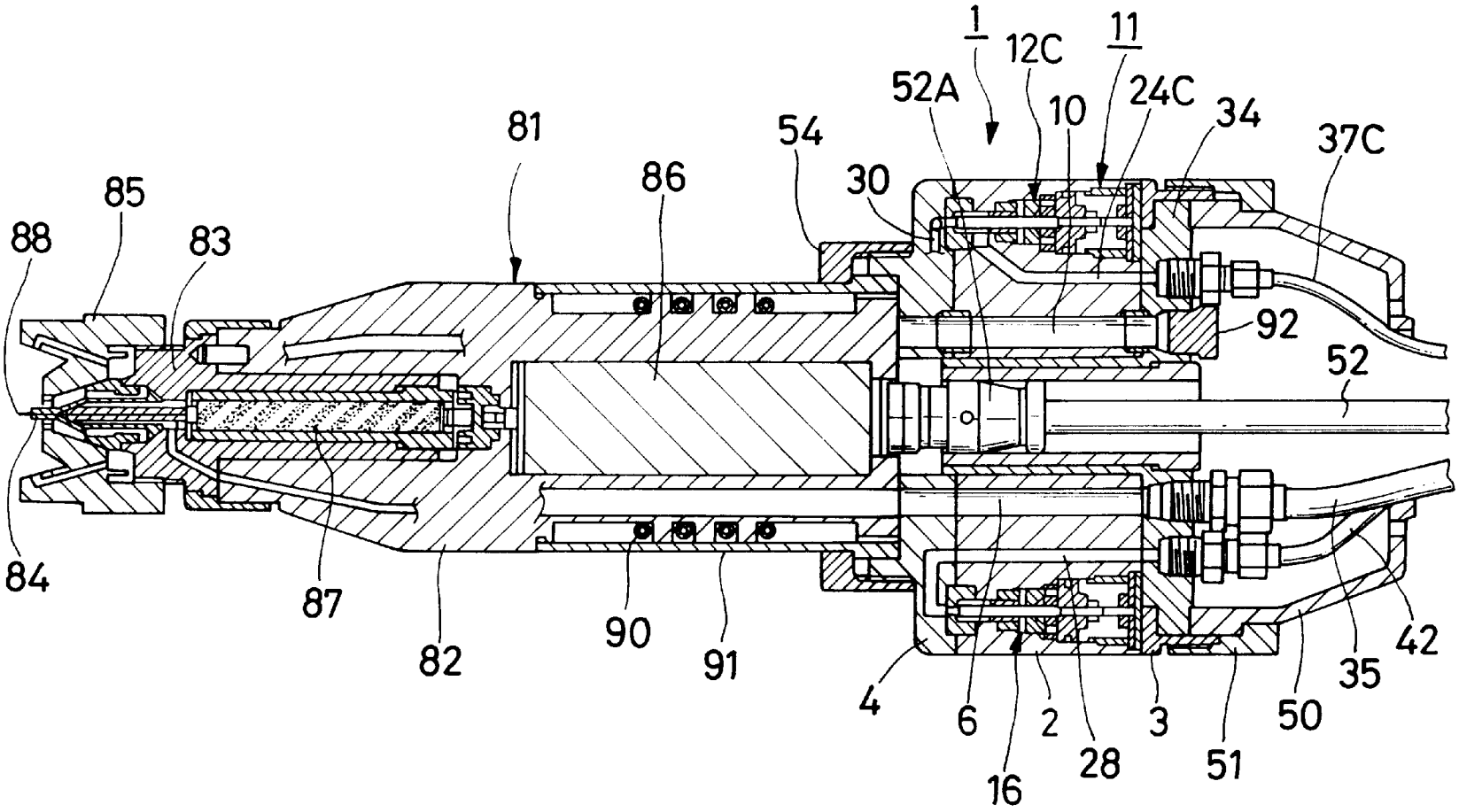
FIG. 10 is a vertical section of the straight spray gun type electrostatic paint applicator unit shown in FIG. 9.
Figure 11:
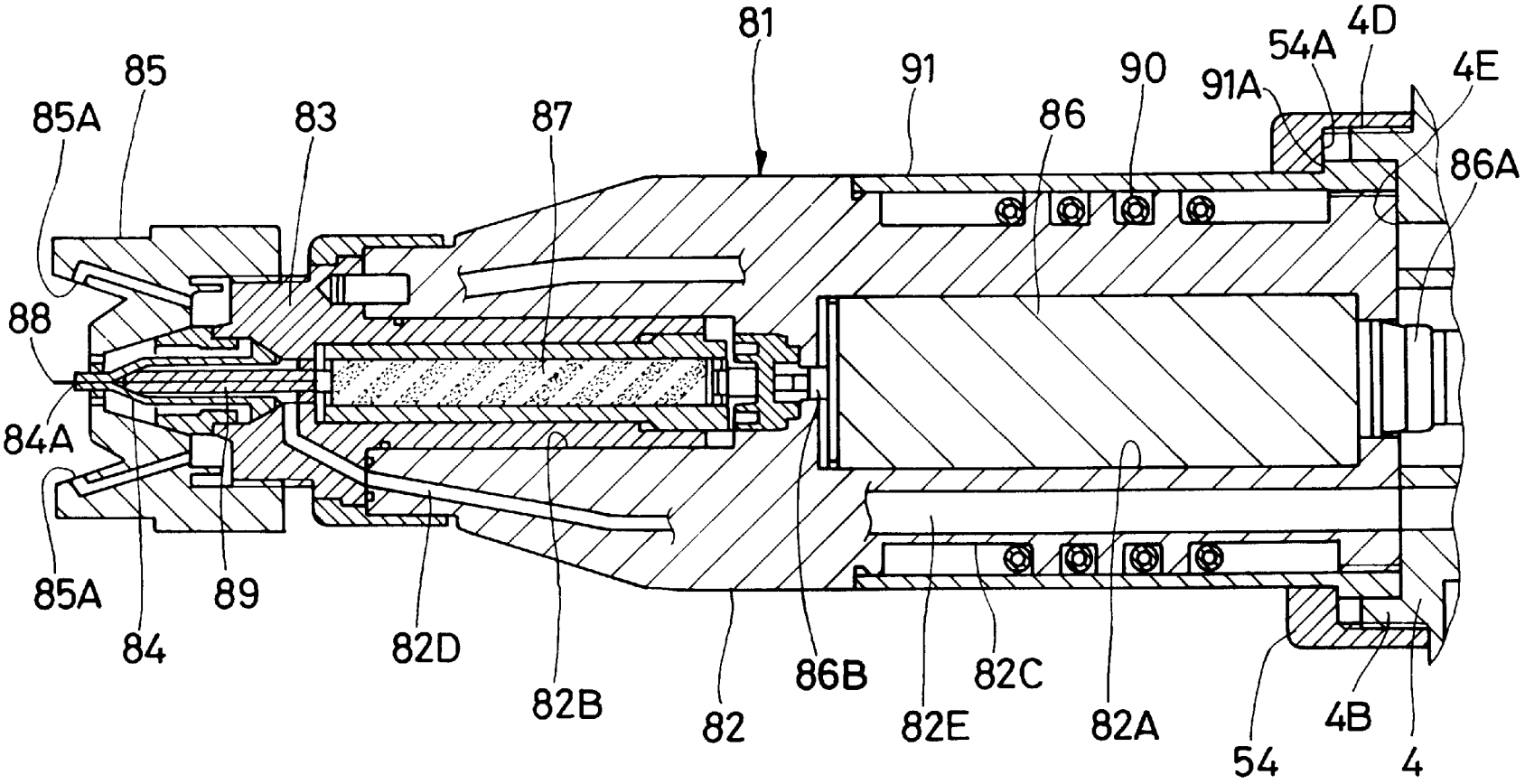
FIG. 11 is an enlarged sectional view of the straight spray gun type electrostatic paint applicator unit shown in FIG. 10.

Turning now to FIGS. 9 to 11, there is shown a straight spray gun type electrostatic paint applicator unit which is detachably mounted on the valve casing 1 in place of the straight rotary atomizing head type electrostatic paint applicator unit 61 or the bent rotary atomizing head type electrostatic paint applicator unit 71.

Namely, indicated at 81 is the above-mentioned straight spray gun type electrostatic paint applicator unit which is detachably connected to the front end of the valve casing 1. This spray gun type electrostatic paint applicator unit 81 is largely constituted by a housing 82, a gun head portion 83, a paint nozzle 84, an air nozzle 85 and high output type high voltage generator 86, as will be described hereinafter.

Denoted at 82 is the housing of the spray gun type electrostatic paint applicator unit 81, which is formed in a straight cylindrical shape having stepped portions as seen in FIGS. 10 and 11 and which is provided with a room 82A in one end portion thereof to accommodate the high voltage generator 86. The gun head portion 83 is fitted in a room 82B which is provided in the other end of the housing 82. Further, the housing 82 is provided with a tube winding portion 82C on its outer periphery between an axially intermediate point and its rear end. Furthermore, the housing 82 is provided with a paint supply passage 82D which supplies paint to the gun head portion 83, and an air passage 82E which supplies atomizing air and patterning air to the air nozzle 85.

The gun head portion 83 is fixedly mounted at the fore end of the housing 82. The gun head 83 is provided with a paint nozzle 84 and an air nozzle 85, which will be described below.

The paint nozzle 84, which is provided on the gun head portion 83, is provided with a paint spraying orifice 84A at its fore distal end, thereby spraying a paint which is supplied through the paint supply passage 82D.

The air nozzle 85 is threaded on the outer periphery of the gun head 83 and provided with a plurality of air outlet holes 85A, through which atomizing air or patterning air is spurted out either to atomize paint particles which are sprayed out from the paint spraying orifice 84A of the paint nozzle 84 or to shape the atomized paint particles into a flat spray pattern.

The high output type high voltage generator 86, which is accommodated in the rear room 82A of the housing 82, is provided with a connector 86A on its lower voltage side for connection to the connector 52A of the power supply cable 52. The higher voltage side of the high voltage generator 86 is electrically connected, through a connector 86B, to a needle electrode 88. In this particular embodiment, similarly to the high output type high voltage generator 67 in the foregoing embodiment, the high voltage generator 86 is constituted by a multi-stage voltage doubler rectifier circuit (Cockcroft circuit), thereby transforming a source voltage from the power supply cable 52 to a predetermined high voltage, for example, to −90 kv to −120 kv for supplying to the needle electrode 88 which will be described below.

Indicated at 87 is a high resistance which is accommodated in the gun head 83, and which is inserted between the high voltage generator 86 and the needle electrode 88 for the purpose of preventing spark discharges which would take place when the needle electrode 88 is brought into an abnormally close proximity of a coating object.

The needle electrode 88, which is located at the center axis of the paint nozzle 84, has its base end portion supported by an electrode holder 89 within the paint nozzle 84. The fore end of the needle electrode 88 is protruded out of the paint spraying orifice 84A. This needle electrode 88, which is connected to the high voltage side of the high voltage generator 86, forms a corona discharge region forward of the paint nozzle 84 to charge sprayed paint particles with a high voltage.

The spiral tube 90, which is wound around the tube winding portion 82C of the housing 82, has its one end communicated with the paint passage 31 and the common paint passage 30, and the other end communicated with the paint supply passage 82D.

The tube cover 91, which is mounted on the housing 82 in such a way as to wrap in the tube winding portion 82C, is formed in a cylindrical shape and provided for the purpose of protecting the spiral tube 90 which is wound around the tube winding portion 82C. The tube cover 91 is provided with an annular stepped portion 91A which is protruded radially outward at one end thereof, for engagement with the stepped portion 54A of the setting nut 54.

The paint applicator unit 81 can be attached to or detached from the front plate 4 by tightening or loosening the setting nut 54 on the part of the paint applicator unit.

Reference numeral 92 denotes a plug which is attached to the plate portion 34A of the rear plate 34 as shown in FIG. 10. The plug 92 is put in the cable passage for the detection cable 36 when it becomes unnecessary to detect the rotational speed of the air motor 63 through the detection cable 36 by replacement of the paint applicator unit, for example, when the rotary atomizing head type electrostatic paint applicator unit 61 or 71 is replaced by the spray gun type electrostatic paint applicator unit 81.

Figure 12:
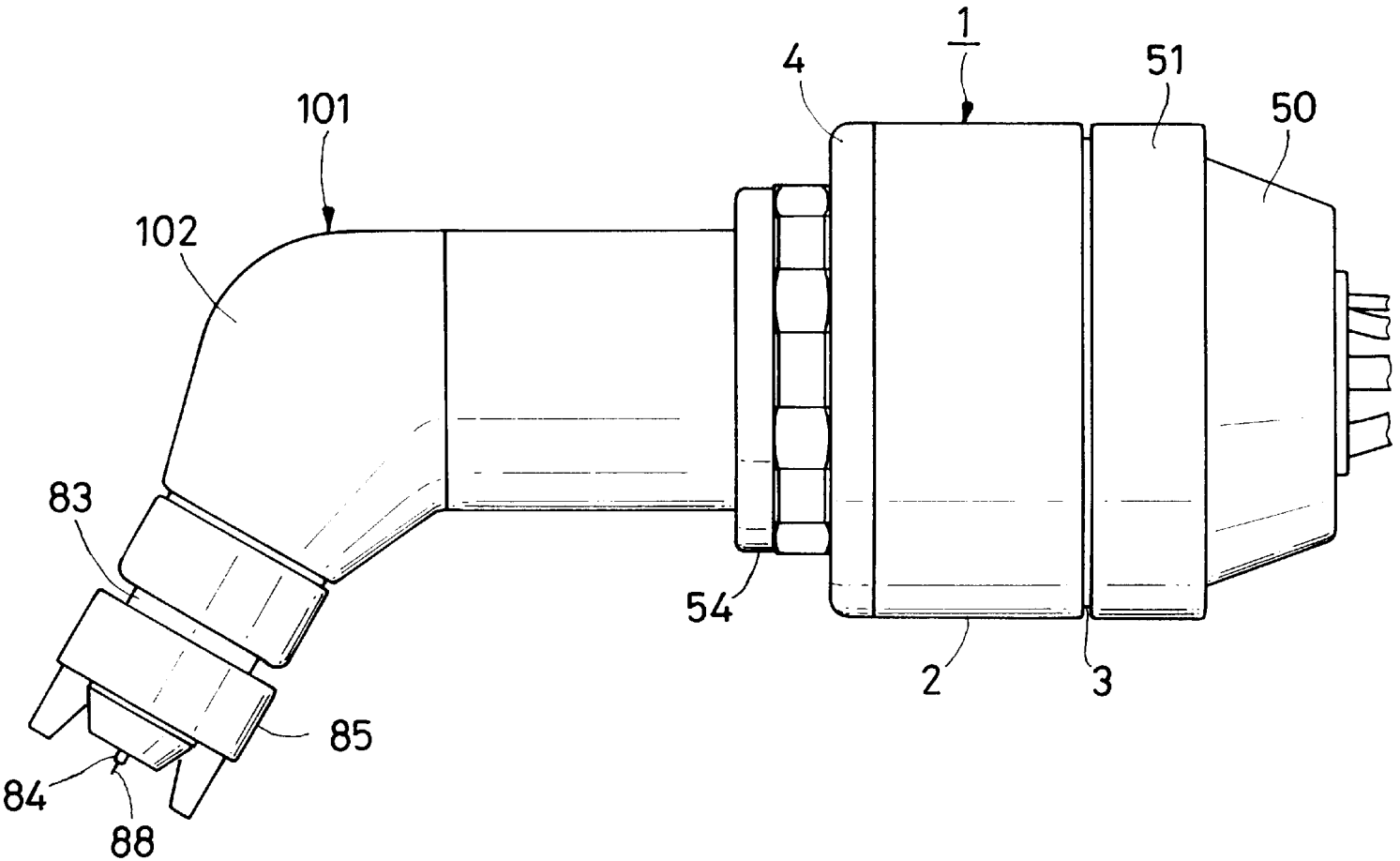
FIG. 12 is a bend spray gun type electrostatic paint applicator unit, as mounted on a valve casing, seen from the same direction as in FIG. 1.

Referring now to FIG. 12, there is shown a bent spray gun type electrostatic paint applicator unit which is detachably mounted on the valve casing 1 in place of either the straight rotary atomizing head type paint applicator unit 61, the bent rotary atomizing head type paint applicator unit 71 or the straight spray gun type paint applicator unit 81.

More specifically, indicated at 101 is a bent spray gun type electrostatic paint applicator unit which is detachably attached to the front end of the valve casing 1. This spray gun type paint applicator unit 101 is provided with a housing 102 which is bent at an axially intermediate portion at an angle of approximately 60 degrees with the axis of the paint applicator unit 101. This angular arrangement is particularly suitable for coating interior surfaces of a vehicle body. Namely, the bent spray gun type electrostatic paint applicator unit 101, which is mounted on a coating robot arm, can be brought into a vehicle body through a window frame or other openings for coating a paint on interior surfaces with complicate contours or shapes.

Except for the housing 102, the component parts which constitute the bent spray gun type electrostatic paint applicator unit 101 are common with the above-described straight spray gun type electrostatic paint applicator unit 81, including the gun head portion, paint nozzle, air nozzle, high output type high voltage generator, tube cover etc. Therefore, in the following description, these common component parts are simply designated by common reference numerals or characters to avoid repetition of same explanations.

Figure 13:
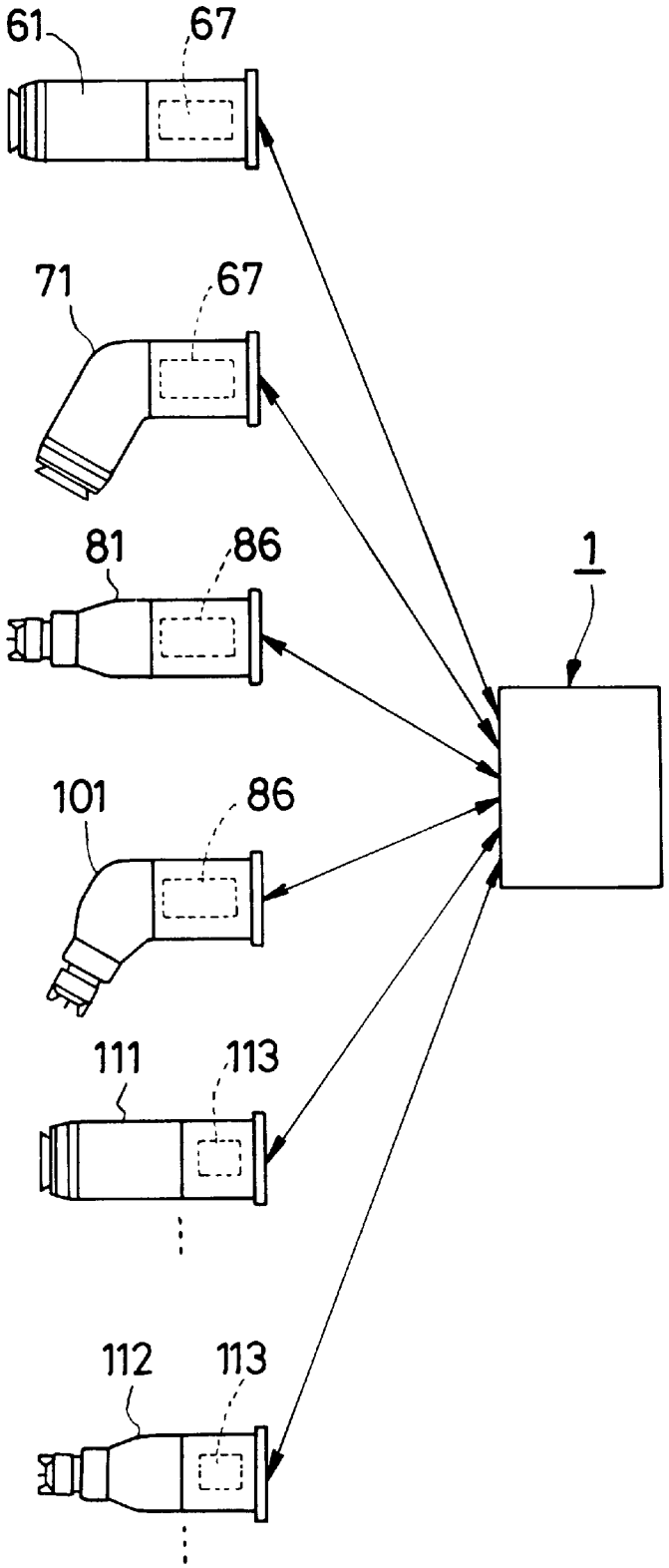
FIG. 13 is a schematic illustration of a plurality of paint applicator units of different types which can be selectively and replaceably mounted on a common valve casing.

Further, according to the present embodiment, additional paint applicator units are provided as shown in FIG. 13. These paint applicator units can be replaceably mounted on the valve casing 1, in addition to the above-described paint applicator units 61 and 71 with the high output type high voltage generator 67 and the paint applicator units 81 and 101 with the high output type high voltage generator 86.

More specifically, as seen in FIG. 13, there are additionally provided a straight rotary atomizing head type electrostatic paint applicator unit 111 and a straight spray gun type electrostatic paint applicator unit 112, which employ, as the voltage doubler rectifier circuit (Cockcroft circuit) a low output type high voltage generator 113 having an output voltage of from −40 kv to −60 kv. Accordingly, these paint applicator units 111 and 112 differ from the above-described paint applicator units 61, 71, 81 and 101 in that their output voltages are lower than those of the paint applicator units 61, 71, 81 and 101 (each having an output voltage of from −90 kv to −120 kv).

According to the paint spraying apparatus of this embodiment, all of these paint applicator units 61, 71, 81, 101, 111 and 112 can be replaceably and interchangeably mounted on the valve casing 1 because the valve casing 1 as well as the color changing valve assembly 11 are shared as a common base by the respective paint applicator units 61, 71, 81, 101, 111 and 112.

With the paint spraying apparatus of this embodiment, which is arranged as described above, a selected one of the paint applicator units 61, 71, 81, 101, 111 and 112, which is replaceably mounted in position on the valve casing 1, is operated in the manner as follows, in a paint coating operation involving a color change or changes.

Firstly, for example, the straight rotary atomizing head type electrostatic paint applicator unit 61 is mounted on the valve casing 1 to perform a paint coating operation on exterior surfaces of a coating object like a vehicle body.

In the first place, for coating exterior surfaces of the vehicle body with a paint of color A, driving air, brake air and bearing air is supplied to the air motor 63 via driving air passage 7, brake air passage 8 and bearing air passage 9, respectively. Then, while detecting the rotational speed of the air turbine 63C on the basis of output signal of the detection cable 36, the rotary atomizing head 64 is put in high speed rotation at a predetermined speed.

In this state, pilot air is supplied to the pilot air supply passage 29A to open the paint valve 12A, whereupon a paint of color A is supplied to the common pain passage 30 from the paint source 43A of color A through the paint feed pipe 37A. Then, the trigger valve 18 is opened in timed relation with a start of coating operation to supply the paint of color A to the paint supply passage 66A of the feed tube 66 through the paint passage 31 and spiral tube 68. Accordingly, from the paint supply passage 66A, the paint is spurted out toward the rotary atomizing head 64. While supplying the paint of color A in this manner, a high voltage in the range of from −90 kv to −120 kv is applied to the air motor 63 from the high output type high voltage generator 67 through the power supply cable 52 to charge a high voltage to the paint of color A flowing through the feed tube 66.

The paint of color A which has been supplied to the rotary atomizing head 64 is sprayed in the form of atomized particles from outer peripheral edges under the influence of centrifugal force resulting from the high-speed rotation of the rotary atomizing head. The sprayed paint particles, which are charged with a high voltage, are urged to fly along an electrostatic field toward the vehicle body which is retained at the earth potential. At the same time, shaping air which is supplied through the shaping air feed pipe 35, shaping air passages 6, 62C, 62D, 65A etc. is spurted out through the respective air outlet holes 65B, thereby atomizing paint particles further and shaping them into a desired spray pattern.

When the necessity arises for changing the paint color from A to B, the paint valve 12 for color A is closed in the first place. Then, the air valve 48 and thinner valve 49 are opened alternately, and at the same time the washing gate valve 14 is opened to supply flushing air and thinner from the air source 45 and thinner source 46 to the common paint passage 30, paint passage 31, spiral tube 68 and paint supply passage 66A for washing away residues of the paint of color A in these passages. At this time, the nose washing valve 15 is opened to wash away the paint of color A which has deposited in fore end portions of the feed tube 66 and on the rotary atomizing head 64, along with the thinner which is flushed through the thinner supply passage 66B of the feed tube 66 via thinner passage 32.

After washing away the paint of color A completely, the paint valve 12B for color B is opened to supply the paint of color B. Whereupon, the paint of color B is supplied from the paint source 43B of color B to the paint supply passage 66A of the feed tube 66 through the paint feed pipe 37B, the common paint passage 30, trigger valve 18 and spiral tube 68 to spray the paint of color B toward the vehicle body from the rotary atomizing head 64.

Nextly, the coating operation which perform a paint coating on the interior surfaces of the vehicle body, which are usually more complicate in contour or shape, is explained. In this case, a bent rotary atomizing head type electrostatic paint applicator unit 71 is now mounted on the valve casing 1 in place of the straight type paint applicator unit 61.

The straight rotary atomizing head type paint applicator unit 61 can be replaced by the bent rotary atomizing head type electrostatic paint applicator unit 71, by simple procedures as explained below.

Firstly, the setting nut 54 on the part of the paint applicator unit is loosened and disengaged from the screw portion 4D of the front plate 4. By so doing, the straight rotary atomizing head type electrostatic paint applicator unit 61 is readily dismantled from the valve casing 1. After dismantling the paint applicator unit 61, the bent rotary atomizing head type paint applicator unit 71 is mounted on the valve casing 1. At this time, the tube cover 69 on the housing 72 is brought into fitting engagement with the stepped portion 4E of the front plate 4, and, in this state, the setting nut 54 on the part of the paint applicator unit is tightly threaded on the screw portion 4D to set the new paint applicator unit in position. In this way, the bent rotary atomizing head type electrostatic paint applicator unit 71 can be set on the valve casing 1 in an extremely facilitated manner.

The bent rotary atomizing head type electrostatic paint applicator unit 71 operates in the same manner as the straight type paint applicator unit 61 in both paint coating operation and color changing operation, so that description in this regard is omitted here to avoid repetitions.

Now, if necessary, the straight spray gun type electrostatic paint applicator unit 81 can be mounted and used for coating operations in place of the rotary atomizing head type electrostatic paint applicator unit 61, similarly in a facilitated manner as described below.

Firstly, the setting nut 54 on the part of the paint applicator unit is loosed and disengaged from the screw portion 4D of the front plate 4 to permit dismantling of the rotary atomizing head type electrostatic paint applicator unit 61 from the valve casing 1. After removal of the paint applicator unit 61, the detection cable 36 is extracted from the cable passage hole 10, and then the plug 92 is put on the rear plate 34. Nextly, the straight spray gun type electrostatic paint applicator unit 81 is set on the valve casing 1. In this instance, the tube cover 91 on the housing 82 is engaged with the stepped portion 4E of the front plate 4 and the setting nut 54 on the part of the paint applicator unit is tightly threaded on the screw portion 4D of the latter. In this manner, the spray gun type paint applicator unit 81 can be easily set on the valve casing 1.

The spray gun type electrostatic paint applicator unit 81 does not involve operations of an air motor. Namely, when the spray gun type electrostatic paint applicator unit 81 is replaced by the rotary atomizing head type electrostatic paint applicator unit 61, the brake air passage 8 as well as the bearing air passage 9 becomes unnecessary. On the part of the spray gun type electrostatic paint applicator unit 81, however, there is no passages which correspond to the air passages 8 and 9, so that these air passages 8 and 9 are suitably blocked in closed state upon attaching the paint applicator unit 81 to the valve casing 1.

In order to coat a paint of color A by the use of the above-described spray gun type electrostatic paint applicator unit 81, firstly, the paint valve 12A and trigger valve 18 are opened. Whereupon, a paint of color A, which is supplied through the paint feed pipe 37A, is fed to the gun head portion 83 through the common paint passage 30, paint passage 31, spiral tube 90 and paint supply passage 82D, and sprayed toward a vehicle body by the paint nozzle 84 on the gun head portion 83. At this time, a high voltage is applied to the needle electrode 88 from the high voltage generator 86, and sprayed paint particles are charged in a corona discharge region which is formed by and forward of the needle electrode 88. As a result, paint particles of color A are urged to fly toward and deposit on the vehicle body which is retained at the earth potential.

Besides, shaping air is simultaneously supplied to the air nozzle 85 through the shaping air pipe 35, shaping air passage 6 and air passage 82E, and spurted out through the respective air outlet holes 85A of the air nozzle 85, thereby atomizing paint particles further and shaping them into a desired spray pattern.

The above-described straight spray gun type electrostatic paint applicator unit 81 can be similarly replaced by a bent spray gun type electrostatic paint applicator unit 101, by extremely simple procedures as explained below.

Firstly, the setting nut 54 on the part of the paint applicator unit is loosed and disengaged from the screw portion 4D of the front plate 4 to permit dismantling of the spray gun type electrostatic paint applicator unit 81 from the valve casing 1. After removal of the paint applicator unit 81, the bent spray gun type electrostatic paint applicator unit 101 is mounted on the valve casing 1. At this time, the tube cover 91 on the housing 102 is brought into engagement with the stepped portion 4E of the front plate 4, and in this state the setting nut 54 on the part of the paint applicator unit is threaded and tightened on the screw portion 4D. In this manner, the spray gun type paint applicator unit of a different type can be easily mounted on the valve casing 10.

Operations with the paint applicator unit 101, including paint coating operations and color changing operations, are same as the operations with the above-described paint applicator unit 71, so that descriptions in this regard are omitted here to avoid repetitions.

According to the present embodiment, depending upon conditions of coating operations such as shapes of coating surfaces and properties or characteristics of a paint to be used, various types of paint applicator units 61, 71, 81, 101, 111 and 112 can be selectively mounted on the valve casing 1 which serves as a common mount base, thereby incorporating the color changing valve assembly for common use by the respective paint applicator units.

Thus, a particular type of paint applicator unit on the valve casing 1 can be easily replaced by a different type of paint applicator unit 61, 71, 81, 101, 111 or 112 according to conditions of a coating operation. This makes it possible to cope easily with alterations in operating conditions of a coating line and to improve productivity as well as working efficiency to a considerable degree. In addition, thanks to the provision of the color changing valve assembly 11 which is adapted to serve for common use by various types of paint applicator units, it becomes possible for each one of the paint applicator units 61, 71, 81, 101, 111 and 112 to dispense with a large number of component parts which would otherwise be necessitated for a color changing valve assembly, in contrast to the conventional way in which a color changing valve assembly has to be built into each one of paint applicator units. Consequently, the paint spraying apparatus according to the present invention contributes to cut production cost markedly through reductions of the number of component parts and to enhancement of working efficiency of an assembly line, at the same time lessening the burden on the part of users through reductions in the number of spare parts which have to be kept in stock.

Further, a selected one of the paint applicator unit 61, 71, 81, 101, 111 and 112 can be mounted in position simply by threading and tightening a setting nut on the part of the paint applicator unit on the screw portion 4D of the front plate 4 which is provided at the front end of the valve casing 1. This arrangement permits to replace a paint applicator unit on the valve casing 1 easily by a different type of paint applicator unit 61, 71, 81, 101, 111 or 112 in an extremely facilitated manner.

Furthermore, on the paint applicator units 61, 71, 81, 101, 111 and 112, the rotary atomizing head 64 or the gun head portion 83 which is applied with a high voltage from the high voltage generator 67, 86 or 113 is communicated with the coloring changing valve assembly 11 through the spiral tube 68 or 90. This spiral tube 68 or 90 serves to increase the electrical resistance between the high voltage generator 67, 86 or 113 and the color changing valve assembly 11, thereby holding the color changing valve assembly 11 on the lower voltage side of the high voltage generator 67, 86 or 113, namely, on the side of the earth potential. As a result, a stand-by portion of the paint, which is filled in the color changing valve assembly 11, can be held as close to the earth potential as possible.

Accordingly, the paint within the color changing valve assembly 11 is constantly held at the earth potential to prevent separation of pigments from the solvent. As a consequence, it becomes possible to preclude the troubles as experienced with prior art coating machines due to deposition of separated pigments in paint passages, e.g., deposition of peeled pigment flakes on coated surfaces, and the bridge phenomenon as occurring in a coating operation with a metallic paint. Thus, the paint coating apparatus can be operated in an extremely reliable manner to improve the quality of coatings.

Further, the paint applicator unit 61, 71, 81, 101, 111 or 112 can be mounted directly on the valve casing 1 which contains a built-in color changing valve assembly 11. Since this arrangement requires no piping work between the color changing valve device 11 and the paint applicator unit 61, 71, 81, 101, 111 or 112, it can also contribute to improvements in working efficiency in an assembly line and reductions of production cost.

Besides, at the time of changing the paint color, a coating operation with a fresh color can be started soon after discarding and washing away only paint residues of previous color in paint passages downstream of the color changing valve assembly 11, i.e., only the paint residues in the common paint passage 30, paint passage 31, spiral tube 68 or 90, paint supply passage 66A or 82D. Accordingly, it becomes possible to reduce the amounts of disposal of paint and thinner on a color change, and to shorten the time required for a color change, in addition to reductions in cost.

On the other hand, within the annular valve casing 1, the respective paint valves 12A to 12G, paint supply valve 13, washing gate valve 14, nose end washing valve 15, discharge valve 16, trigger valve 18 are circularly arranged in the circumferential direction of the valve casing 1. Thanks to this annular arrangement, all of the paint valves 12A to 12G, paint supply valve 13, washing gate valve 14, nose end washing valve 15, discharge valve 16 and trigger valve 18 can be efficiently arranged in a compact form within the annular valve casing 1. This means that the valve casing 1 (color changing valve assembly 11) can be provided in a compact form which is significantly reduced in size and weight and therefore helps in improving the performance of a coating robot for achieving higher quality of coatings.

In the foregoing embodiments, the paint spraying apparatus of the present invention has been described by way of electrostatic paint applicator units 61, 71, 81, 101, 111 and 112 which are provided with a high voltage generator 67, 86 and 113 to charge paint particles with a high voltage. However, it is to be understood that the present invention is applicable to other types of paint applicator units which are arranged to spray and deposit a paint on a coating object without using a high voltage generator.

Further, in replaceably mounting the paint applicator units 61, 71, 81, 101, 111 and 112 on the valve casing 1, there may be employed fixation means other than the setting nut 54 which is provided on the part of each paint applicator unit. For example, the respective paint applicator units may be directly coupled with the valve casing through threaded engagement therewith or detachably mounted on the valve casing 1 by the use of bolts and nuts if desired.

As clear from the foregoing detailed description, according to the present invention, a color changing valve assembly is constituted by a plurality of paint valves which are accommodated in valve mounting bores in a valve casing to feed a variety of paint in color. Besides, various types of paint applicator units can be replaceably mounted on the valve casing depending upon conditions of paint coating operations required. Therefore, a number of paint applicator units can be selectively and interchangeably used to cope with alterations in conditions of paint coating operations, thereby commonly using the valve casing and the color changing valve assembly built in the valve casing.

Consequently, paint applicator units of different types can be interchangeably replaceably mounted on the valve casing according to conditions of coating operations, using the color changing valve assembly commonly for different types of paint applicator units. This arrangement makes it possible to cope easily with alterations in operating conditions of a coating line, contributing to improve productivity and working efficiency to a significant degree. In addition, in contrast to prior art counterparts which require to provide a color changing valve assembly on each paint applicator unit, the present invention allows to share a large number of component parts among different types of paint applicator units, thereby realizing a marked reduction in the number of necessary component parts to enhance productivity. Furthermore, according to the present invention, each paint applicator unit can be directly coupled with the valve casing without necessitating any piping work for connecting the paint applicator unit with the valve casing (color changing valve assembly), facilitating and simplifying the assembling work and at the same time allowing to cut the production cost.

We claim:

1. A paint spraying apparatus comprising;

a valve casing having a plurality of valve mounting bores, along with a paint applicator unit coupling portion provided at a front end thereof;

a color changing valve assembly having a plurality of paint valves accommodated in said valve mounting bores to feed paints of various colors selectively to a paint applicator unit; and a plurality of paint applicator units of different types each having an atomizing head for atomizing and spraying a paint supplied from the color changing valve assembly toward a coating object;

said paint applicator units being selectively and replaceably connectible to said paint applicator unit coupling portion at the front end of said valve casing depending upon conditions of paint coating operation, using said valve casing as a common mount base wherein said paint applicator is equipped with a built-in high voltage generator for electrically charging sprayed paint particles, and an atomizing head of said paint applicator unit is communication with said paint passage of said color changing valve assembly through a spiral tube to retain said color valve assembly in said valve casing on the lower voltage side of said high voltage generator.

2. A paint spraying apparatus as defined in claim 1, wherein said paint applicator units include a rotary atomizing head type paint applicator unit having a rotary atomizing head to be put in high-speed rotation by an air motor to atomize paint supplied from said color changing valve assembly, a spray gun type paint applicator unit having a paint nozzle to spray paint supplied from said color changing valve assembly, both of said rotary atomizing head type paint applicator unit and spray gun type paint applicator unit being selectively and detachably connectible to said valve casing.

3. A paint spraying apparatus as defined in claim 2, wherein said application units are provided with an annular clamp member at a rear end portion thereof, and one of said paint applicator units is detachably connected to the paint application unit coupling of said valve casing by way of said clamp member.

4. A paint spraying apparatus as defined in claim 2, wherein a nose end washing valve is accommodated in a valve mounting bore in the valve casing to supply flushing thinner to fore end portions of a paint passage in said paint applicator unit at the time of washing a nose end portion.

5. A paint spraying apparatus as defined in claim 1, wherein said paint applicator units include a straight type paint applicator unit having a straight housing for spraying a paint supplied from said color changing valve assembly axially in a straightforward direction, and a bent type paint applicator unit having an angularly bent housing for spraying a paint supplied from said color changing valve assembly in a direction off the axis of said valve casing, either one of said straight type paint applicator unit and said bent type paint applicator unit being selectively and replaceably connected to said valve casing.

6. A paint spraying apparatus as defined in claim 5, wherein said application units are provided with an annular clamp member at a rear end portion thereof, and one of said paint applicator units is detachably connected to said valve casing by way of said clamp member.

7. A paint spraying apparatus as defined in claim 5, wherein said paint applicator unit is a rotary atomizing head type paint applicator unit, and a nose end washing valve is accommodated in a valve mounting bore in the valve casing to supply flushing thinner to fore end portions of a paint passage in said paint applicator unit at the time of washing a nose end portion.

8. A paint spraying apparatus as defined in claim 1, wherein said paint applicator units include a low output type paint applicator unit having a low output type high voltage generator, and a high output type paint applicator unit having a high output type high voltage generator, both of said low and high output type paint applicator units being selectively and detachably connectible to said valve casing.

9. A paint spraying apparatus as defined in claim 8, wherein application units are provided with an annular clamp member at a rear end portion thereof, and one of said paint applicator units is detachably connected to said valve casing by way of said clamp member.

10. A paint spraying apparatus as defined in claim 8, wherein said paint applicator unit is a rotary atomizing head type paint applicator unit, and a nose end washing valve is accommodated in a valve mounting bore in the valve casing to supply flushing thinner to fore end portions of a paint passage in said paint applicator unit at the time of washing a nose end portion.

11. A paint spraying apparatus as defined in any one of claims 1, 2, 5 or 8, wherein said applicator units are provided with an annular clamp member at a rear portion thereof, and one of said paint applicator units is detachably connected to the paint application coupling portion of said valve casing by way of said clamp member.

12. A paint spraying apparatus as defined in claim 1, wherein a common paint passage intercommunicates said paint valves, and a washing valve is located at an upstream end of said common paint passage to supply flushing wash air and thinner thereto.

13. A paint spraying apparatus as defined in claim 12, wherein said paint applicator unit is a rotary atomizing head type paint applicator unit, and a nose end washing valve is accommodated in a valve mounting bore in the valve casing to supply flushing thinner to fore end portions of a paint passage in said paint applicator unit at the time of washing a nose end portion.

14. A paint spraying apparatus as defined in claim 1, wherein said paint applicator unit is a rotary atomizing head type paint applicator unit, and a nose end washing valve is accommodated in a valve mounting bore in the valve casing to supply flushing thinner to fore end portions of a paint passage in said paint applicator unit at the time of washing a nose end portion.

15. A paint spraying apparatus, comprising:

a valve casing having a plurality of valve mounting bores, along with a paint applicator unit coupling portion provided at a front end thereof;

a color changing valve assembly having a plurality of paint valves accommodated in said valve mounting bores to feed paints of various colors selectively to a paint applicator unit; and a plurality of paint applicator units of different types each having an atomizing head for atomizing and spraying a paint supplied from the color changing valve assembly toward a coating object;

said paint applicator units being selectively and replaceably connectable to said paint applicator unit coupling portion at the front end of said valve casing depending upon conditions of paint coating operation, using said valve casing as a common mount base, wherein said paint applicator unit is equipped with a built-in high voltage generator for electrically charging sprayed paint particles, and an atomizing head of said paint applicator unit is communicated with a paint passage of said color changing valve assembly through a spiral tube to retain said color changing valve assembly in said valve casing on the lower voltage side of said high voltage generator.

16. A paint spraying apparatus, comprising:

a valve casing having a plurality of valve mounting bores, along with a paint applicator unit coupling portion provided at a front end thereof;

a color changing valve assembly having a plurality of paint valves accommodated in said valve mounting bores to feed paints of various colors selectively to a paint applicator unit; and a plurality of paint applicator units of different types each having an atomizing head for atomizing and spraying a paint supplied from the color changing valve assembly toward a coating object;

said paint applicator units being selectively and replaceably connectable to said paint applicator unit coupling portion at the front end of said valve casing depending upon conditions of paint coating operation, using said valve casing as a common mount base, wherein said paint applicator units include a straight type paint applicator unit having a straight housing for spraying a paint supplied from said color changing valve assembly axially in a straightforward direction, and a bent type paint applicator unit having an angularly bent housing for spraying a paint supplied from said color changing valve assembly in a direction off the axes of said valve casing, either one of said straight type paint applicator unit and said bent type paint applicator unit being selectively and replaceably connected to said valve housing, wherein said paint applicator unit is equipped with a built-in high voltage generator for electrically charging sprayed paint particles, and an atomizing head of said paint applicator unit is communicated with a paint passage of said color changing valve assembly through a spiral tube to retain said color changing valve assembly in said valve casing on the lower voltage side of said high voltage generator.

17. A paint spraying apparatus, comprising:

a valve casing having a plurality of valve mounting bores, along with a paint applicator unit coupling portion provided at a front end thereof;

a color changing valve assembly having a plurality of paint valves accommodated in said valve mounting bores to feed paints of various colors selectively to a paint applicator unit; and a plurality of paint applicator units of different types each having an atomizing head for atomizing and spraying a paint supplied from the color changing valve assembly toward a coating object;

said paint applicator units being selectively and replaceably connectable to said paint applicator unit coupling portion at the front end of said valve casing depending upon conditions of paint coating operation, using said valve casing as a common mount base wherein said paint applicator units include a low output type paint applicator unit having a low output type high voltage generator, and a high output type paint applicator unit having a high output type high voltage generator, both of said low and high output type paint applicator units being selectively and detachably connectable to said valve casing, wherein said paint applicator unit is equipped with a built-in high voltage generator for electrically charging sprayed paint particles, and an atomizing head of said paint applicator unit is communicated with a paint passage of said color changing valve assembly through a spiral tube to retain said color changing valve assembly in said valve casing on the lower voltage side of said high voltage generator.

* * * * *